US009626906B2

(12) United States Patent
Kim et al.

(10) Patent No.: US 9,626,906 B2
(45) Date of Patent: Apr. 18, 2017

(54) ORGANIC LIGHT EMITTING DEVICE

(71) Applicant: LG DISPLAY CO., LTD., Seoul (KR)

(72) Inventors: Dongik Kim, Seongnam-si (KR); Kiwon Son, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/557,495

(22) Filed: Dec. 2, 2014

(65) Prior Publication Data

US 2015/0179102 A1 Jun. 25, 2015

(30) Foreign Application Priority Data

Dec. 20, 2013 (KR) ..... 10-2013-0160151

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2320/0233* (2013.01)

(58) Field of Classification Search
CPC ..... G02F 1/1333; G02F 1/13338; G02F 2001/133334; G06F 2203/04103; G06F 3/041; G06F 3/0412; H01L 27/323
USPC ..... 345/210–212, 690
See application file for complete search history.

(56) References Cited

U.S. PATENT DOCUMENTS

| | | | | |
|---|---|---|---|---|
| 6,099,576 | A * | 8/2000 | Jiang | 716/50 |
| 2007/0001711 | A1* | 1/2007 | Kwak | 324/770 |
| 2009/0033817 | A1 | 2/2009 | Ooida et al. | |
| 2011/0157132 | A1* | 6/2011 | Byun et al. | 345/211 |
| 2011/0164018 | A1* | 7/2011 | Kang et al. | 345/211 |
| 2013/0113779 | A1* | 5/2013 | Yoon | G09G 3/3233 345/212 |
| 2013/0147856 | A1* | 6/2013 | Chou et al. | 345/690 |
| 2014/0204067 | A1* | 7/2014 | Gupta | 345/211 |
| 2015/0235584 | A1* | 8/2015 | Eom | 345/213 |

FOREIGN PATENT DOCUMENTS

| | | | |
|---|---|---|---|
| CN | 1551081 | A | 12/2004 |
| CN | 1719503 | A | 1/2006 |
| CN | 101501754 | A | 8/2009 |
| CN | 101615627 | A | 12/2009 |

* cited by examiner

*Primary Examiner* — Tony Davis
(74) *Attorney, Agent, or Firm* — Dentons US LLP

(57) ABSTRACT

Disclosed is an organic light emitting display in which a sensing period during which the source voltage of the driving TFT is raised toward a data voltage applied to a gate electrode of the driving TFT in order to compensate a change in mobility of the driving TFT, a first gate signal is maintained at an ON level and a second gate signal is maintained at an OFF level, and the first and second gate signals are maintained at an OFF level in a light emission period following the sensing period; and a first falling time of the first gate signal and a second falling time of the second gate signal, which indicate a period of time required to change from the ON level to the OFF level, are set to be longer than a predetermined reference value, respectively.

12 Claims, 25 Drawing Sheets

X1 or/and X2 : Vth external compensation
DP : $\mu$ internal compensation

| G-IC Slope (FT) | | 0.5μs | 3μs |
|---|---|---|---|
| Sensing period (Ts) | | 2.6μs | 3.5μs |
| g63 | Far |  |  |
| | Near |  |  |
| ΔTs | | \|2.9 − 2.6\| = 0.3μs | \|3.6 − 3.5\| = 0.1μs |

| G-IC Slope (FT) | 0.5μs | 3μs |
|---|---|---|
| Panel 휘도 |   |   |
| Global Uniformity | 83% | 90% |

— :High grayscale (Diffrenec in currrent 6% @ μ=+20%)

— :Low grayscale (Diffrenec in currrent Less than 2% @ μ=+20%)

— :High grayscale (Diffrenec in currrent Less than 2% @ μ=+20%)

— :Low grayscale (Diffrenec in currrent Less than 2% @ μ=+20%)

| ΔFT (WS1-WS2) | ΔFalling Time = 2.9μs | ΔFalling Time = 5.9μs |
|---|---|---|
| g63 | Optimum Ts : 3.1μs<br>  <br> | Optimum Ts : 4.8μs<br>  <br> |
| g127 | Optimum Ts : 2.7μs<br>  <br> | Optimum Ts : 5.0μs<br>  <br> |
| ΔTs \|g63-g127\| | \|3.1 - 2.7\| = 0.4μs | \|4.8 - 5.0\| = 0.2μs |

| Division | Panel near | Panel far |
|---|---|---|
| Ts | 4.00 μs | 3.07 μs |

0.93 μs

| Division | Panel near | Panel far |
|---|---|---|
| Ts | 4.00 μs | 3.59 μs |

0.41 μs

| Gate signal voltage level | Same VGH/Same VGL (WS1, WS2) | Differential VGH/Differential VGL (WS1, WS2) |
|---|---|---|
| g63 | Global Uniformity [%] @g63   | Global Uniformity [%] @g63   |
| Difference in brightness | 80.1% | 87.4% |

7.3% improvement of difference in brightness

—— : Panel far
(Diffrenec in currrent Less than 2% @ $\mu$=+20%)

—— : Panel near @ Before application of present invention
(Diffrenec in currrent 6% @ $\mu$=+20%)

—— : Panel near @ After application of present invention
(Diffrenec in currrent Less than 2% @ $\mu$=+20%)

—— : Panel far
(Diffrenec in currrent Less than 2% @ $\mu$=+20%)

—— : Panel near @ Before application of present invention
(Diffrenec in currrent 6% @ $\mu$=+20%)

—— : Panel near @ After application of present invention
(Diffrenec in currrent Less than 2% @ $\mu$=+20%)

| | | Cst Size<br>Before designing of variation | Cst Size<br>After designing of variation<br>(Far over Near: 20% decrease in size) |
|---|---|---|---|
| g63 | Near | Optimum Ts : 2.6μs<br>ΔIoled [%] @g63, Near<br>  | Optimum Ts : 2.6μs<br>ΔIoled [%] @g63, Near<br>  |
| | Far | Optimum Ts : 3.1μs<br>ΔIoled [%] @g63, Far<br>  | Optimum Ts : 2.6μs<br>ΔIoled [%] @g63, Far<br>  |
| ΔTs<br>Far-Near | | 3.1 − 2.6 = 0.5μs | 2.6 − 2.6 = 0μs |

ORGANIC LIGHT EMITTING DEVICE

This application claims the benefit of Korea Patent Application No. 10-2013-0160151 filed on Dec. 20, 2013, which is incorporated herein by reference for all purposes as if fully set forth herein.

BACKGROUND OF THE INVENTION

Field of the Invention

This disclosure relates to an active matrix type organic light emitting display.

Discussion of the Related Art

An active matrix type organic light emitting display covers an organic light emitting diode (hereinafter, referred to as "OLED") which emits light by itself, and has advantages of a fast response speed, high light emitting efficiency, high brightness, and a wide viewing angle.

The OLED, which is a self light emitting device, includes an anode electrode, a cathode electrode, and organic compound layers (HIL, HTL, EML, ETL, and EIL) formed therebetween. The organic compound layers include a hole injection layer (HIL), a hole transport layer (HTL), an emission layer (EML), an electron transport layer (ETL), and an electron injection layer (EIL). When a driving voltage is applied to the anode electrode and the cathode electrode, holes passing through the hole transport layer (HTL) and electrons passing through the electron transport layer (ETL) move into the emission layer (EML) to form an exciton, and as a result, the emission layer (EML) emits a visible light.

In the organic light emitting display, pixels each including an OLED are arranged in a matrix type, and the brightness of the pixels is controlled according to the grayscale of video data. Each of the pixels includes a driving thin film transistor (TFT) for controlling a driving current flowing through the OLED. The organic light emitting display has a problem in that electric characteristics of TFT, such as threshold voltage and mobility of the driving TFT, are not uniform for the pixels, and thus the current levels with respect to the same data voltage, that is, the light emission amounts of OLEDs are different for the pixels, causing a difference in brightness.

For solving the problem, a hybrid compensation manner is proposed that non-uniform brightness due to a difference in threshold voltage of the diving TFT is compensated in an external compensation manner, and non-uniform brightness due to a difference in mobility of the driving TFT is compensated in an internal compensation manner. Specifically, according to the hybrid compensation manner, the difference in the threshold voltage of the driving TFT is compensated by sensing threshold voltages of driving TFTs for the respective pixels and correcting input data according to the sensed values.

In addition, according to the hybrid compensation manner, the difference in mobility of the driving TFT is compensated by raising the source voltage level of the driving TFT in a source follower manner while the gate voltage level of the driving TFT is fixed to a data voltage during the sensing period. The driving current determining the light emission amount (brightness) of the pixel is proportional to the mobility of the driving TFT and the gate-source voltage of the driving TFT programmed in the sensing period. With respect to a pixel having large mobility, the source voltage of the driving TFT promptly is raised toward the gate voltage, which is higher than the source voltage, during the sensing period, so that the gate-source voltage of the driving TFT is programmed to be small. On the contrary to this, with respect to a pixel having small mobility, the source voltage of the driving TFT is slowly raised toward the gate voltage, which is higher than the source voltage, during the sensing period, so that the gate-source voltage of the driving TFT is programmed to be large. As a result, the difference in brightness due to the difference in mobility between pixels is compensated.

With respect to this hybrid compensation manner, the sensing period during which the difference in mobility of the driving TFT is internally compensated may be determined by a gate signal applied to each pixel. However, the gate signal varies depending on the display position due to RC delay, causing a difference in the sensing period depending on the display position. Meanwhile, the difference in the sensing period may be shown depending on the display grayscale. In the case where the sensing period varies depending on the display position or the display grayscale, the performance of compensating the mobility of the driving TFT also varies accordingly, and thus the uniformity in brightness of the display panel may deteriorate.

SUMMARY OF THE INVENTION

Accordingly, an aspect of the present invention is to provide an organic light emitting display in which, when the difference in mobility of a driving TFT is compensated in a hybrid compensation manner, the difference in the sensing period depending on the display position or the display grayscale is decreased, thereby improving the performance of compensating mobility of the driving TFT and the uniformity in brightness of the display panel.

According to an aspect of the present invention, an organic light emitting display, comprises: a display panel having a plurality of pixels each including an organic light emitting diode, a driving TFT controlling a driving current flowing through the organic light emitting diode depending on a voltage difference between a gate electrode connected to a first node and a source electrode connected to a second node, a first switch TFT switched in response to a first gate signal to apply a data voltage to the first node, a second switch TFT switched in response to a second gate signal to apply an initialization voltage to the second node, and a storage capacitor connected between the first node and the second node; a data driving circuit supplying the data voltage to a data line connected to the pixels and supplying the initialization voltage to a reference line connected to the pixels; and a gate driving circuit supplying the first gate signal to a first gate line connected to the pixels and supplying the second gate signal to a second gate line connected to the pixel, wherein, in a sensing period during which a change in mobility of the driving TFT is compensated, the first gate signal is maintained at an ON level and the second gate signal is maintained at an OFF level, and the first and second gate signals are maintained at an OFF level in a light emission period following the sensing period, and wherein a first falling time of the first gate signal and a second falling time of the second gate signal, which indicate a period of time required to change from the ON level to the OFF level, are set to be longer than a predetermined reference value, respectively.

The first and second falling times may be set to be 4-6 times longer than the reference value.

The second falling time may be set to be longer than the first falling time.

The gate driving circuit may include a first CMOS inverter outputting the first gate signal through a first output node, and a second CMOS inverter outputting the second gate signal through a second output node; the first CMOS inverter may include a first PMOS transistor connected between a high-voltage power of the ON level and the first output node and a first NMOS transistor connected between a low-voltage power of the OFF level and the first output node; the second CMOS inverter may include a second PMOS transistor connected between a high-voltage power of the ON level and the second output node and a second NMOS transistor connected between a low-voltage power of the OFF level and the second output node; and the channel capacities of the first and second NMOS transistors may be, respectively, controlled according to the setting of the first and second falling times.

A voltage difference between the ON level and the OFF level of the first gate signal may be equal to a voltage difference between ON level and the OFF level of the second gate signal; and the ON levels of the first and second gate signals may be different from each other, and the OFF levels of the first and second gate signals may be different from each other.

The ON level of the first gate signal may be higher than the ON level of the second gate signal, and the OFF level of the first gate signal may be higher than the OFF signal of the second gate signal.

Herein, when the RC delay applied to the first and second gate signals is gradually increased from a first region toward a second region of the display panel, the channel capacity of the driving TFT may be gradually increased from the first region toward the second region.

Herein, when the RC delay applied to the first and second gate signals is gradually increased from a first region toward a second region of the display panel, the capacitance of the storage capacitor may be gradually decreased from the first region toward the second region.

Herein, when the RC delay applied to the first and second gate signals is gradually increased from a first region toward a second region of the display panel, the channel capacity of the driving TFT may be gradually increased from the first region toward the second region, and the capacitance of the storage capacitor may be gradually decreased from the first region toward the second region.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Hereinafter, preferable embodiments of the present invention will be described with reference to FIGS. 1 to 25.

Figure 1:
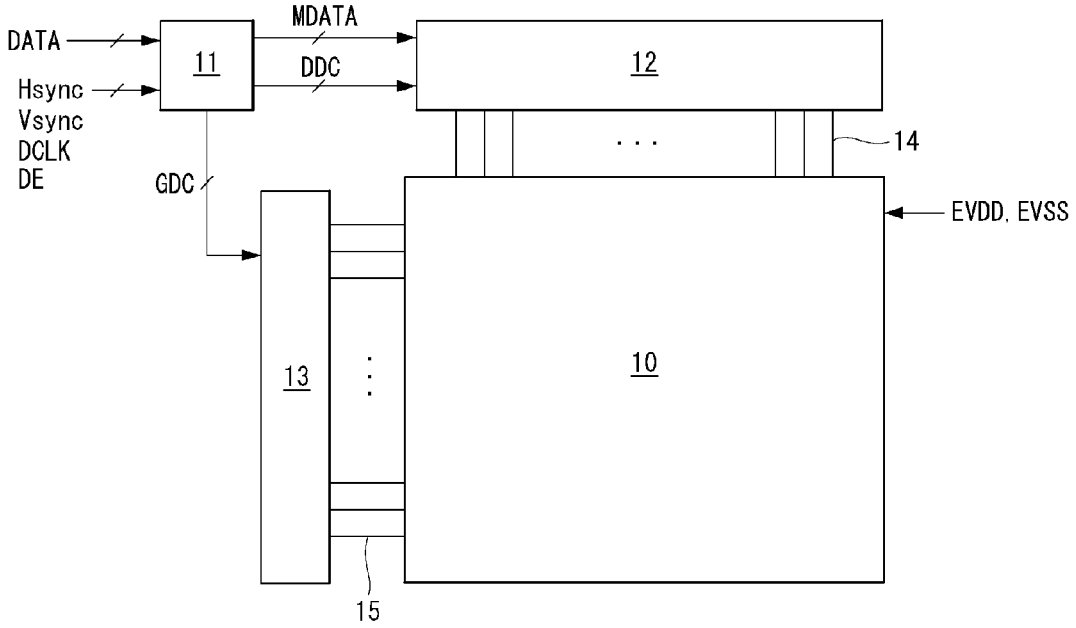
FIG. 1 is a diagram showing an organic light emitting display according to an embodiment of the present invention.
Figure 2:
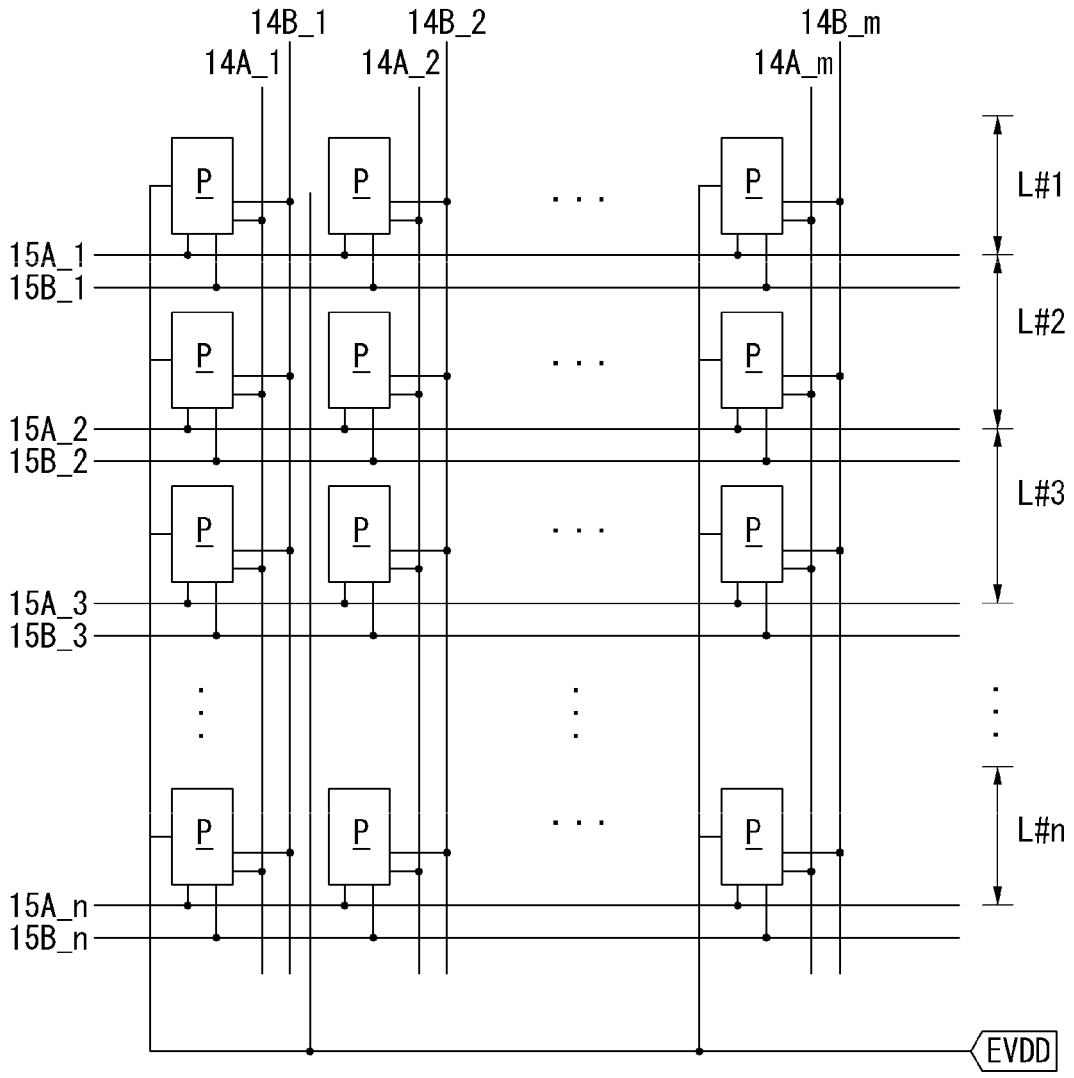
FIG. 2 is a diagram showing a pixel array formed on a display panel of FIG. 1.

FIG. 1 is a diagram showing an organic light emitting display according to an embodiment of the present invention; and FIG. 2 is a diagram showing a pixel array formed on a display panel of FIG. 1.

Referring to FIGS. 1 and 2, an organic light emitting display according to an embodiment of the present invention includes a display panel 10, a data driving circuit 12, a gate driving circuit 13, and a timing controller 11.

In the display panel 10, a plurality of data lines 14 and a plurality of gate lines 15 cross each other, and pixels P are formed in the respective crossings and arranged in a matrix type. The data lines 14 include m (m is a positive integer) data voltage supply lines 14A_1 to 14A_m and m reference lines 14B_1 to 14B_m. In addition, the gate lines 15 include n (n is a positive integer) first gate lines 15A_1 to 15A_n and n second gate lines 15B_1 to 15B_n.

Each of the pixels P receives a high driving voltage EVDD and a low driving voltage EVSS from a power generator not shown. Each of the pixels P of the present invention compensates the change in threshold voltage and the change in mobility of a driving TFT according to a hybrid compensation manner. That is, the pixel (P) of the present invention compensates the non-uniform brightness due to the difference in threshold voltage of the driving TFT in an external compensation manner, and compensates the non-uniform brightness due to the difference in mobility of the driving TFT in an internal compensation manner, Each of the pixels P is connected to any one of the data voltage supply lines 14A_1 to 14A_m, any one of the reference lines 14B_1 to 14B_m, any one of the first gage lines 15A_1 to 15A_n, and any one of the second gate lines 15B_1 to 15B_n. Each of the pixels P compensates the difference in mobility of the driving TFT through a principle in which, at the time of normal driving including the compensation of mobility, the source voltage of the driving TFT is set to a reference voltage during an initialization period, and then the source voltage of the driving TFT is raised in a capacitor coupling manner while the gate voltage of the driving TFT is fixed to a data voltage, during the sensing period. In addition, each of the pixels P displays a desired grayscale by maintaining the gate-source voltage of the driving TFT, which is programmed during the sensing period, in the light emission period.

The data driving circuit 12, at the time of threshold voltage compensation driving, which is implemented separately from the normal driving, supplies a predetermined data voltage for sensing to the pixels P, and converts the sensing voltages, which are input from the display panel 10 through the reference lines 14B_1 to 14B_m, into digital values to supply the digital value to the timing controller 11. The timing controller 11 may generate digital compensation data MDATA, which is capable of compensating the change in threshold voltage of the driving TFT, by modulating input digital video data DATA based on the digital sensing value indicating the variation in threshold voltage of the driving TFT.

The data driving circuit 12, at the time of normal driving, converts the digital compensation data MDATA, which are input from the timing controller 11, into a data voltage for image display in response to a data control signal DDC, and then supplies the data voltage for image display to the data voltage supply lines 14A_1 to 14A_m. The data driving circuit 12, at the time of normal driving, may a reference voltage to the reference lines 14B_1 to 14B_m in response to the data control signal DDC.

The gate driving circuit 13 generates a gate signal in response to a gate control signal GDC from the timing controller 11. The gate driving circuit 13, at the time of normal driving, may supply a first gate signal to the first gate lines 15A_1 to 15A_n in a line sequence manner, and supply a second gate signal to the second gate lines 15B_1 to 15B_n in a line sequence manner. Meanwhile, the gate driving circuit 13 may supply the first and second gate signals to the first and second gate lines, respectively, even at the time of threshold voltage compensation driving. The gate driving circuit 13 may be formed directly on the display panel 10 according to a gate-driver in panel (GIP) manner.

The timing controller 11 generates the data control signal DDC for controlling the operation timing of the data driver 12 and the gate control signal GDC for controlling the operation timing of the gate driver 13, based on timing signals, such as a vertical synchronization signal Vsync, a horizontal synchronization signal Hsync, a dot clock signal DCLK, and a data enable signal DE. In addition, the timing controller 11 modulates the input digital video data DATA with reference to the digital sensing voltage value supplied from the data driving circuit 12, thereby generating the digital compensation data MDATA for compensating the change in threshold voltage of the driving TFT, and then supplying the digital compensation data MDATA to the data driving circuit 12. The timing controller 11 may deduce a compensation value capable of compensating the change in threshold voltage of the driving TFT based on the digital sensing voltage value supplied from the data driving circuit 12, and update a memory storage value using the compensation value.

The timing controller 11, at the time of normal driving for image display, controls the operation timings of the data driving circuit 12 and the gate driving circuit 13 to compensate the change in mobility of the driving TFT, and controls the operation timings of the data driving circuit 12 and the gate driving circuit 13 to compensate the change in threshold voltage of the driving TFT.

Figure 3:
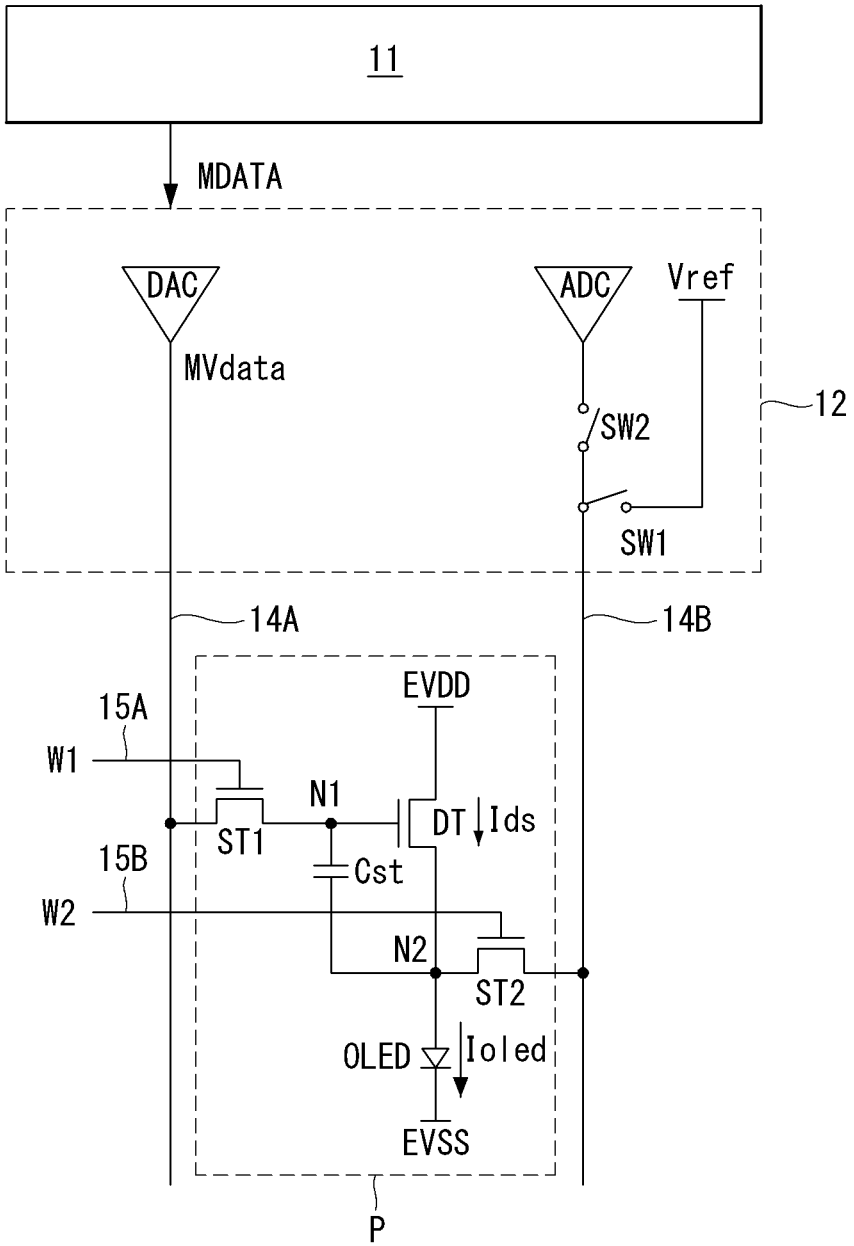
FIG. 3 is a diagram showing a pixel of the present invention to which a hybrid compensation manner is applied.
Figure 4:
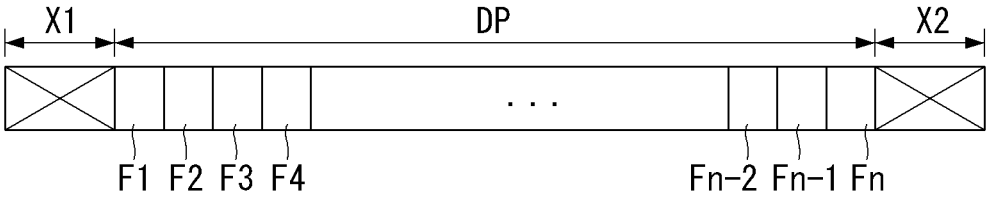
FIG. 4 is a diagram showing a period during which the change in threshold voltage of the driving TFT is compensated in an external compensation manner, and a period during which the change in mobility of the driving TFT is compensated in an internal compensation manner.
Figure 5:
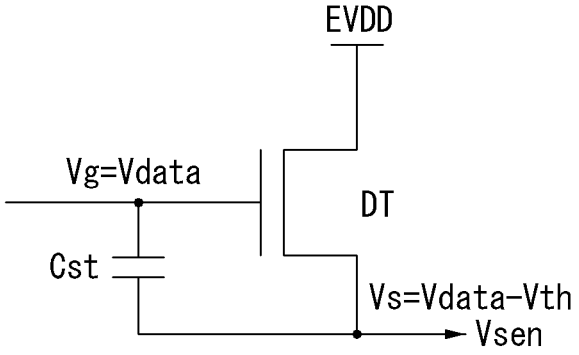
FIG. 5 is a diagram illustrating a principle in which the change in threshold voltage of the driving TFT is compensated.
Figure 5:
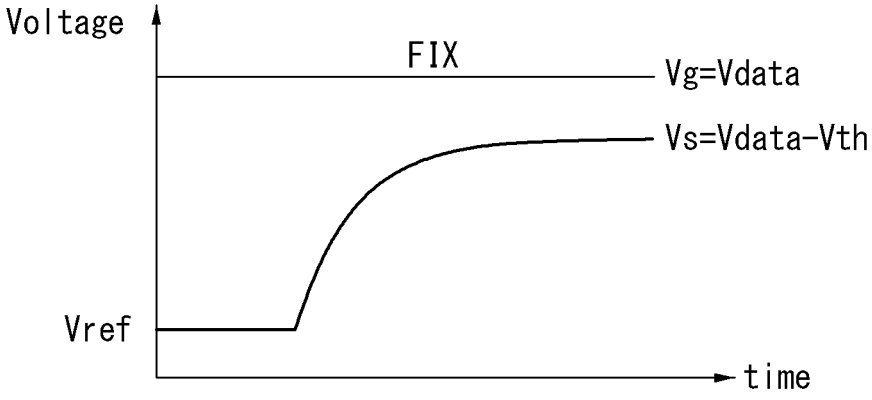
Figure 6:
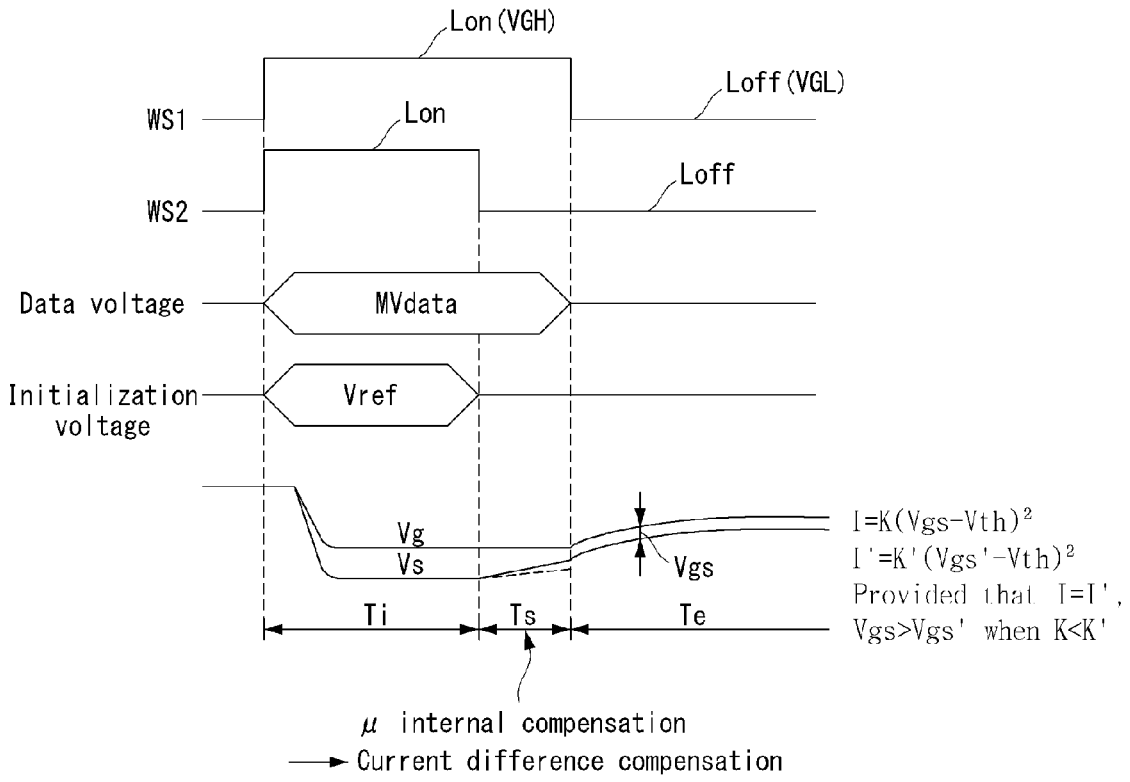
FIG. 6 is a diagram illustrating a principle in which the change in mobility of the driving TFT is compensated.
Figure 7:
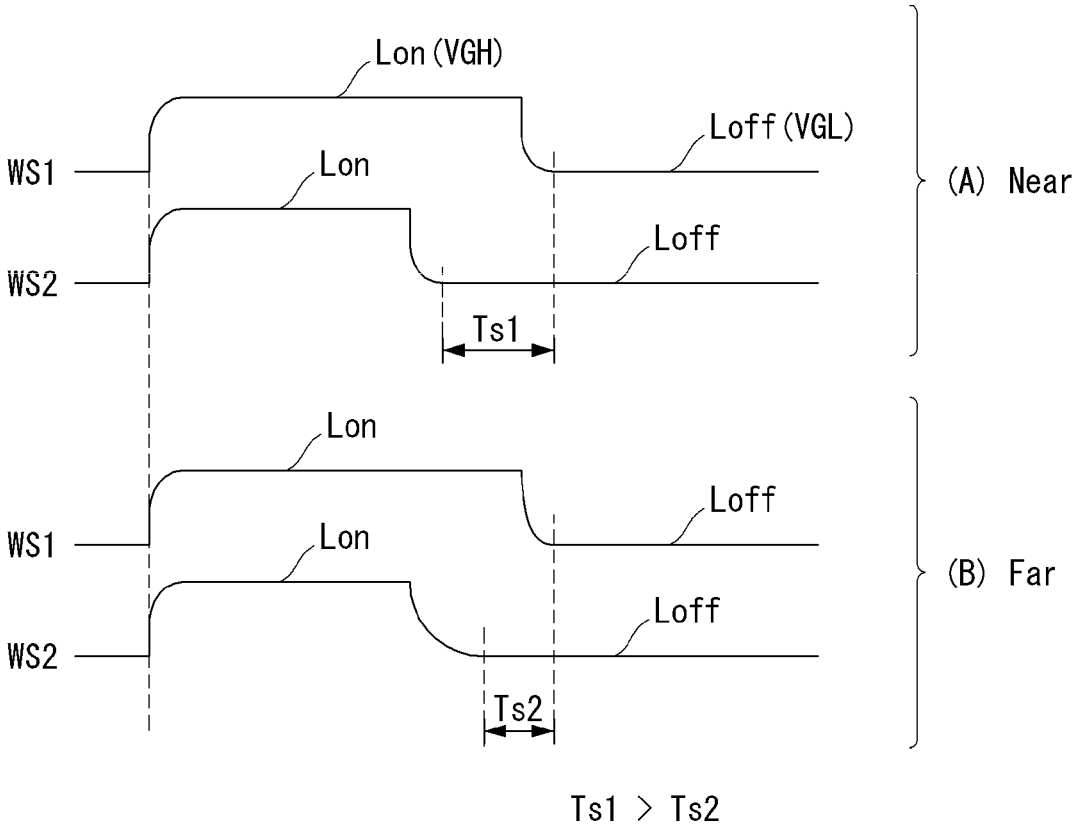
FIG. 7 is a diagram showing one example in which the difference in the sensing period is made depending on the display position.

FIG. 3 shows a pixel of the present invention to which a hybrid compensation manner is applied. FIG. 4 shows a period during which the change in threshold voltage of the driving TFT is compensated in an external compensation manner, and a period during which the change in mobility of the driving TFT is compensated in an internal compensation manner. FIG. 5 illustrates a principle in which the change in threshold voltage of the driving TFT is compensated; and FIG. 6 illustrates a principle in which the change in mobility of the driving TFT is compensated. FIG. 7 shows one example in which the difference in the sensing period is made depending on the display position.

Referring to FIG. 3, for the hybrid compensation, the pixel P of the present invention may include an OLED, a driving TFT DT, a storage capacitor Cst, a first switch TFT ST1, and a second switch TFT ST2. TFTs constituting the pixel P may be implemented in a p type or an n type. In addition, each semiconductor layer of the TFTs constituting the pixel P may contain amorphous silicon, polysilicon, or oxide.

The OLED includes an anode electrode connected to a second node N2, a cathode electrode connected to a low-voltage power EVSS, and an organic compound layer positioned between the anode electrode and the cathode electrode.

The driving TFT DT controls the current Ioled flowing through the OLED according to the gate-source voltage Vgs of the driving TFT DT. The driving TFT DT includes a gate electrode connected to the first node N1, a drain electrode connected to a high-voltage power EVDD, and the source electrode connected to a second node N2.

The storage capacitor Cst is connected between the first node N1 and the second node N2.

The first switch TFT ST1 is switched in response to the first gate signal WS1 to apply a data voltage MVdata for image display charging the data voltage supply line 14A (a data voltage in which the change in threshold voltage of the driving TFT is compensated) to the first node N1. The first switch TFT ST1 includes a gate electrode connected to a first gate line 15A, a drain electrode connected to a data voltage supply line 14A, and a source electrode connected to the first node N1.

The second switch TFT ST2 is switched in response to the second gate signal WS2 to apply an initialization voltage Vref charging the reference line 14B to the second node N2. The gate electrode of the second switch TFT ST2 is connected to the second gate line 15B, the drain electrode of the second switch TFT ST2 is connected to the second node N2, and the source electrode of the switch TFT ST2 is connected to the reference line 14B.

Meanwhile, the data driving circuit 12 is connected to the pixel P through the data voltage supply line 14A and the reference line 14B. The data driving circuit 12 may include a digital-analog converter DAC for converting the digital compensation data MDATA into a data voltage MVdata for image display, an analog-digital converter ADC operated to convert an analog sensing voltage into a digital sensing value at the time of sensing driving for an external compensation manner, a sampling switch SW2, and an initialization switch SW1 for supplying an initialization voltage Vref.

Meanwhile, the change in mobility (μ) of the driving TFT may be compensated according to an internal compensation manner in an image display section DP, as shown in FIG. 4. Whereas, the change in threshold voltage Vth of the driving TFT may be compensated according to an external compensation manner in a first non-display section X1 disposed at the front of the image display section DP and/or a second non-display section X2 disposed at the rear of the image display section X0, as shown in FIG. 4. Here, the first non-display section X1 may be defined by a section immediately from when a driving power enable signal is applied to when an image is displayed, and the second non-display section X2 may be defined by a section immediately from when a driving power disenable signal is applied to when a driving voltage is shut.

A principle in which the change in threshold voltage Vth of the driving TFT is sensed and compensated in an external compensation manner will be described with reference to FIG. 5. According to the external compensation manner, the driving TFT DT is operated in a source follower manner, and then receives, as a sensing voltage Vsen, a voltage when the source voltage Vs of the driving TFT DT is saturated, and modulates input digital video data to compensate the change in threshold voltage of the driving TFT DT based on the sensing voltage Vsen. The external compensation may be performed in at least one of the non-display sections X1 and X2 since the time required until the source voltage Vs of the driving TFT DT is saturated is relatively long.

A principle in which the change in mobility (μ) of the driving TFT is sensed and compensated in an internal compensation manner will be described with reference to FIGS. 3 and 6. The normal driving for the internal compensation is performed by including an initialization period Ti, a sensing period Ts, and a light emission period Te.

In the initialization period Ti, both of the first and second gate signals WS1 and WS2 are maintained at an ON level (Lon). A gate high voltage VGH of 24 V may be selected for the ON level (Lon), but is not limited thereto. The first switch TFT ST1 is turned on in response to the first gate signal WS1 of an ON level, to apply a data voltage MVdat to the gate electrode of the driving TFT DT, and the second switch TFT ST2 is turned on in response to the second gate signal WS2 of an ON level, to apply an initialization voltage Vref to the source electrode of the driving TFT DT.

In the sensing period Ts, the first gate signal WS1 is maintained at an ON level (Lon) and the second gate signal WS2 is maintained at an OFF level (Loff). A gate low voltage VGL of −6 V may be selected for the OFF level (Loft), but is not limited thereto. The first switch TFT ST1 is maintained at a turn-on state, and thus the gate voltage Vg of the driving TFT DT is maintained at the data voltage MVdata. The second TFT ST2 is turned off, and here, the current corresponding to the gate-source voltage Vgs, which is set in the initialization period Ti flows through the driving TFT DT. Therefore, the source voltage Vs of the driving TFT DT is raised toward the data voltage MVdata applied to the gate electrode of the driving TFT DT according to a source follower manner, and the gate-source voltage Vgs of the driving TFT DT is programmed to meet the desired grayscale level.

In the light emission period Te, both of the first and second gate signals WS1 and WS2 are maintained at an OFF level (Loft). The gate voltage Vg and the source voltage Vs of the driving TFT DT are raised to a voltage level higher than the threshold voltage of the OLED while the gate-source voltage Vgs of the driving TFT DT programmed in the sensing period Ts is maintained. The driving current corresponding to the programmed gate-source voltage Vgs of the driving TFT DT flows through the OLED, and as a result, the OLED emits light and implements a desired grayscale.

As such, according to the internal compensation manner, the change in mobility of the driving TFT DT is compensated through a principle in which, during the sensing period Ts, the source voltage Vs of the driving TFT DT is raised in a capacitor coupling manner while the gate voltage Vg of the driving TFT DT is fixed to a data voltage MVdata. The driving current determining the light emitting amount (brightness) of the pixel is proportional to mobility (μ) of the driving TFT DT (included in K or K' in equations) and the gate-source voltage Vgs of the driving TFT DT programmed in the sensing period Ts, as shown in mathematical formulas of FIG. 6. During the sensing period (Ts), in the pixel having large mobility (K), the source voltage Vs of the driving TFT DT is raised toward the gate voltage Vg, which is higher than the source voltage Vs, at a first rise slope, and thus the gate-source voltage Vgs of the driving TFT DT is programmed to be relatively small. On the contrary, during the sensing period (Ts), in the pixel having small mobility (K'), the source voltage Vs of the driving TFT DT is raised toward the gate voltage Vg, which is higher than the source voltage Vs, at a second rise slope (being gentler than the first rise slope), and thus the gate-source voltage Vgs of the driving TFT DT is programmed to be relatively large. That is, the gate-source voltage is automatically programmed to be inversely proportional to the mobility during the sensing period, and as a result, the difference in brightness due to the difference in mobility (μ) between pixels is compensated.

Meanwhile, the sensing period Ts is defined by a period of time while the first gate signal WS1 is maintained at an ON level and the second gate signal WS2 is maintained at an OFF level, and this sensing period Ts varies depending on the display position or the display grayscale. The reason the sensing period Ts varies depending on the display position is that the degrees of delay of the first and second gate signals WS1 and WS2 varies depending on the display position due to RC delay. For example, as shown in FIG. 7, the sensing period Ts is longer in a first region (a region disposed near to the gate driving circuit) of the display panel having a small RC delay rather than in a second region (a region disposed far from the gate driving circuit) of the display panel having a large RC delay (Ts1>Ts2) Here, since, unlike the first switch TFT ST1, all the second switches TFT ST2 are commonly connected to the reference lines, which are connected to each other, to have a relatively large RC value, the degree of delay of the second gate signal WS2 may be larger than the degree of delay of the first gate signal WS1 at the same position on the display panel. In addition, the higher the grayscale, the shorter the optimum sensing period Ts, and the reason is that, at the time of sensing the mobility (μ), the higher the data voltage, the better the sensing performance.

As the difference in the sensing period Ts is increased depending the display position or the display grayscale, the performance of compensating the mobility (μ) of the driving TFT DT and the uniformity in brightness of the display panel deteriorate. Thus, the performance of compensating the difference in mobility (μ) of the driving TFT DT is largely influenced by the sensing period Ts. Therefore, it is important to set the optimum sensing period during which the difference depending on the display position or the display grayscale is minimized. Hereinafter, the scheme to minimize the difference in sensing period (Ts) depending on the display position or the display grayscale will be described through various embodiments.

First Embodiment

Figure 8:
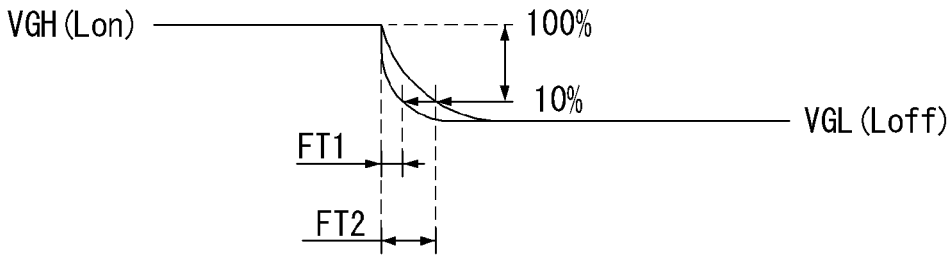
FIG. 8 is a diagram illustrating one scheme to minimize the difference in the sensing period depending on the display position.
Figure 9:
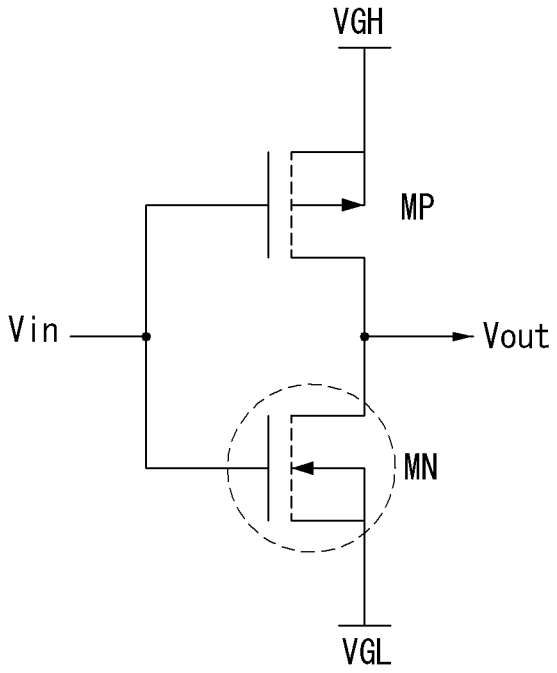
FIG. 9 is a diagram showing one structure of a gate driving circuit for controlling the output slope.
Figure 10:
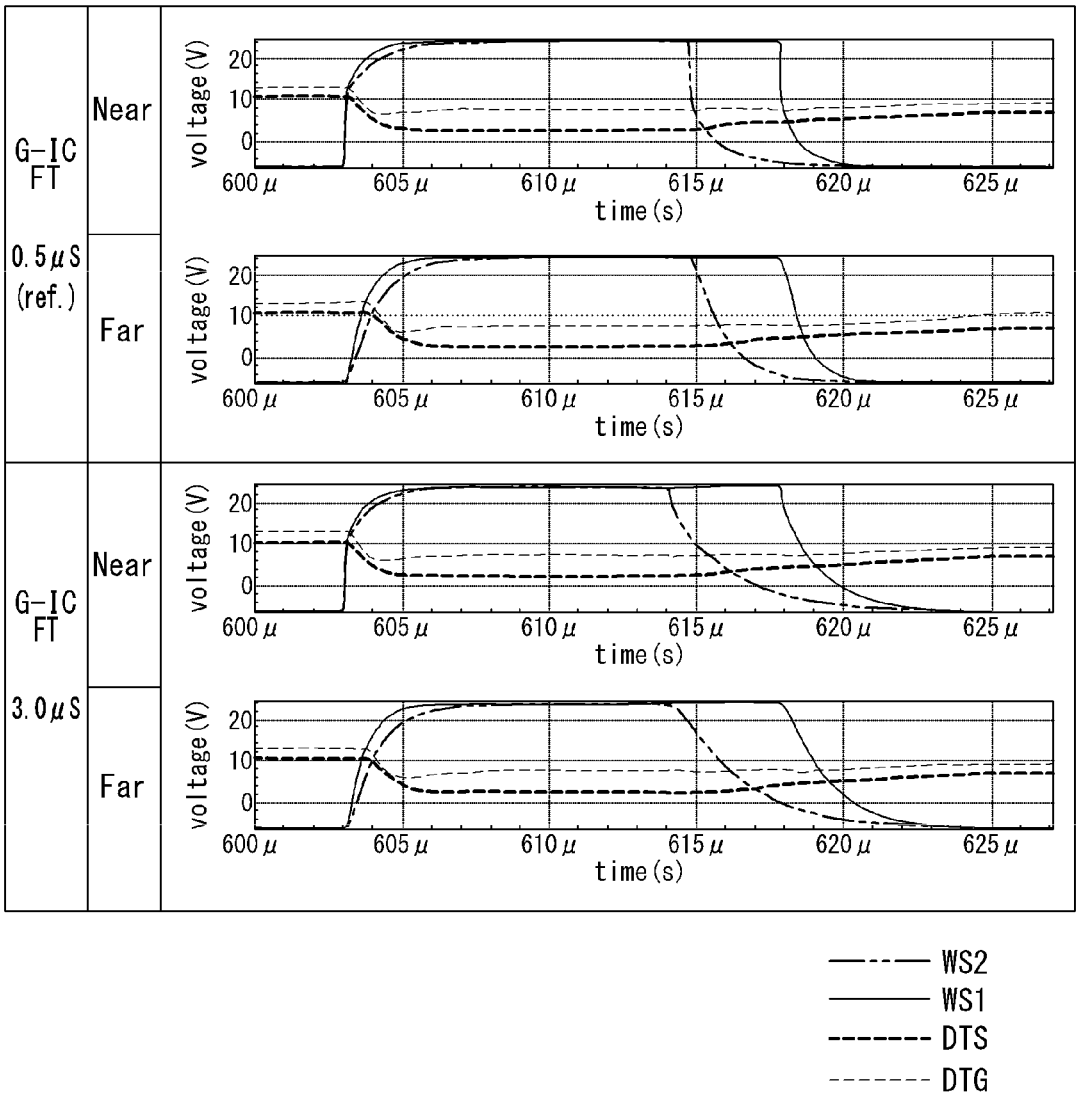
FIGS. 10 and 11 show that the difference in the sensing period depending on the display position is decreased when the falling times of the first and second gate signals are increased to be longer than the reference value.
Figure 11:
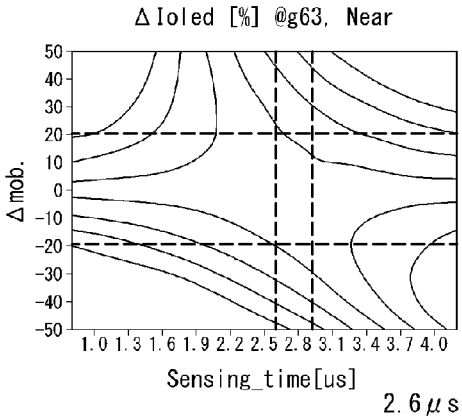
Figure 11:
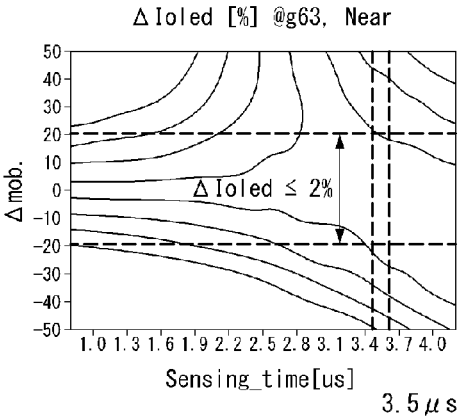
Figure 11:
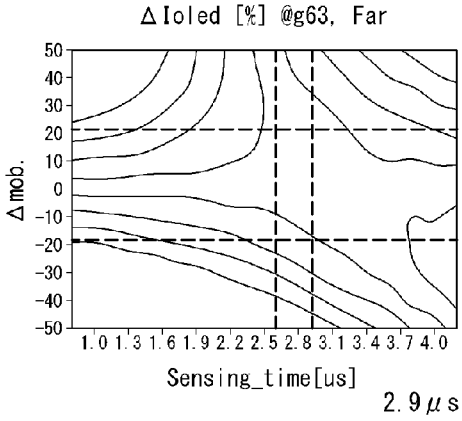
Figure 11:
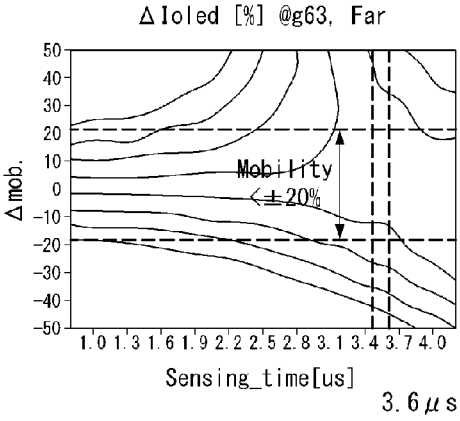
Figure 12:
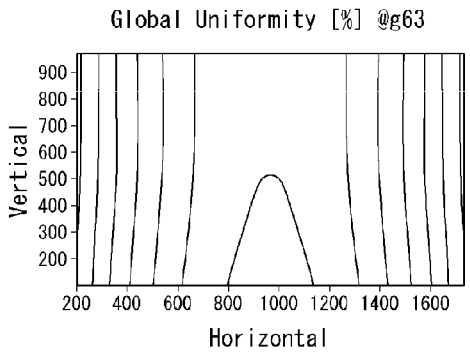
FIG. 12 shows that the uniformity in brightness of the display panel is improved when the falling times of the first and second gate signals are increased to be longer than the reference value.
Figure 12:
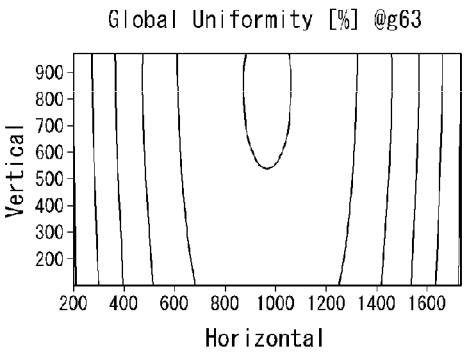

FIG. 8 illustrates one scheme to minimize the difference in the sensing period (Ts) depending on the display position. FIG. 9 shows one structure of the gate driving circuit (13) for controlling the output slope. FIGS. 10 and 11 show that the difference in the sensing period (Ts) depending on the display position is decreased when the falling times of the first and second gate signals WS1 and WS2 are increased to be longer than the reference value. FIG. 12 shows that the uniformity in brightness of the display panel is improved when the falling times of the first and second gate signals WS1 and WS2 are increased to be longer than the reference value.

As one scheme to minimize the difference in the sensing period (Ts) depending on the display position, the falling times of the first and second gate signals WS1 and WS2 are set to be longer than the predetermined reference value through the control of the output slope of the gate driving circuit 13. As used herein, the term "falling time" is defined by a period of time required to change the ON level (Lon) from 100% to 10% when the first and second gate signals WS1 and WS2 each falls from the ON level to the OFF level, as shown in FIG. 8. In the case where the output slope of the gate driving circuit 13 is lengthened, the falling time may be increased from the reference value "FT1" to "FT2", which is larger than "FT1". The reference value "FT1" may vary depending on the model of a panel, and herein, a value of 0.5 μs may be selected as an example thereof.

The gate driving circuit 13 may include two CMOS inverters each configured as shown in FIG. 9, in order to control the falling times of the first and second gate signals WS1 and WS2. A first CMOS inverter outputting the first gate signal WS1 through a first output node includes a first PMOS transistor MP connected between a high-voltage power of an ON level Lon and a first output node, and a first NMOS transistor MN connected between a low-voltage power VGL of an OFF level Loff and the first output node. A second CMOS inverter outputting the second gate signal WS2 through a second output node includes a second PMOS transistor MP connected between a high-voltage power of an ON level Lon and a second output node, and a second NMOS transistor MN connected between a low-voltage power VGL of an OFF level Loff and the second output node.

In this CMOS inverter structure, the channel width of the NMOS transistor MN is controlled to change the ON resistance of the NMOS transistor MN, thereby controlling the falling times of the first and second gate signals WS1 and WS2. As the channel width of the NMOS transistor MN is decreased, the falling times of the first and second gate signals WS1 and WS2 are increased. In the present invention, the channel capacities (channel width/channel length) of the first and second NMOS transistors can be controlled according to the setting of the desired first and second falling times, respectively.

When the falling times of the first and second gate signals WS1 and WS2 are increased, the rising degrees of the source voltages of the driving TFTs are similar regardless of the display position on the display panel in the optimum sensing periods for different display positions of the display panel, as shown in FIG. 10. In order to determine the optimum sensing period, the amount of mobility of the driving TFT to be compensated depending on the sensing period (Ts) needs to be found. It is assumed that the time while the mobility is compensated to ±20% is the optimum sensing period, provided that the difference in current of ±2% or less is the optimum compensation range at the time of mobility changing. Under this assumption, the optimum sensing periods depending for different display positions at the falling times of 0.5 μs and 3 μs are shown in FIG. 11. As can be clearly seen from simulation results of FIG. 11, the difference of the optimum sensing period depending on the display position (ΔTs) at the time of falling time of 3 μs is 0.1 μs, which is greatly decreased when compared with 0.3 μs, which is the difference of the optimum sensing period depending on the display position (ΔTs) at the time of falling time of 0.5 μs. As such, according to the present invention, the first and second falling times are set to be 4-6 times longer than a predetermined reference value, thereby significantly decreasing the difference in the optimum sensing period depending on the display position and thus greatly improving the uniformity in brightness of the display panel. When the global uniformity in brightness of the display panel is numerically expressed through simulation as shown in FIG. 12, the uniformity in brightness at the falling time of 3 μs was shown to be a level of 90%, which was improved by 7% compared with that at the falling time of 0.5 μs (reference value).

Second Embodiment

Figure 13:
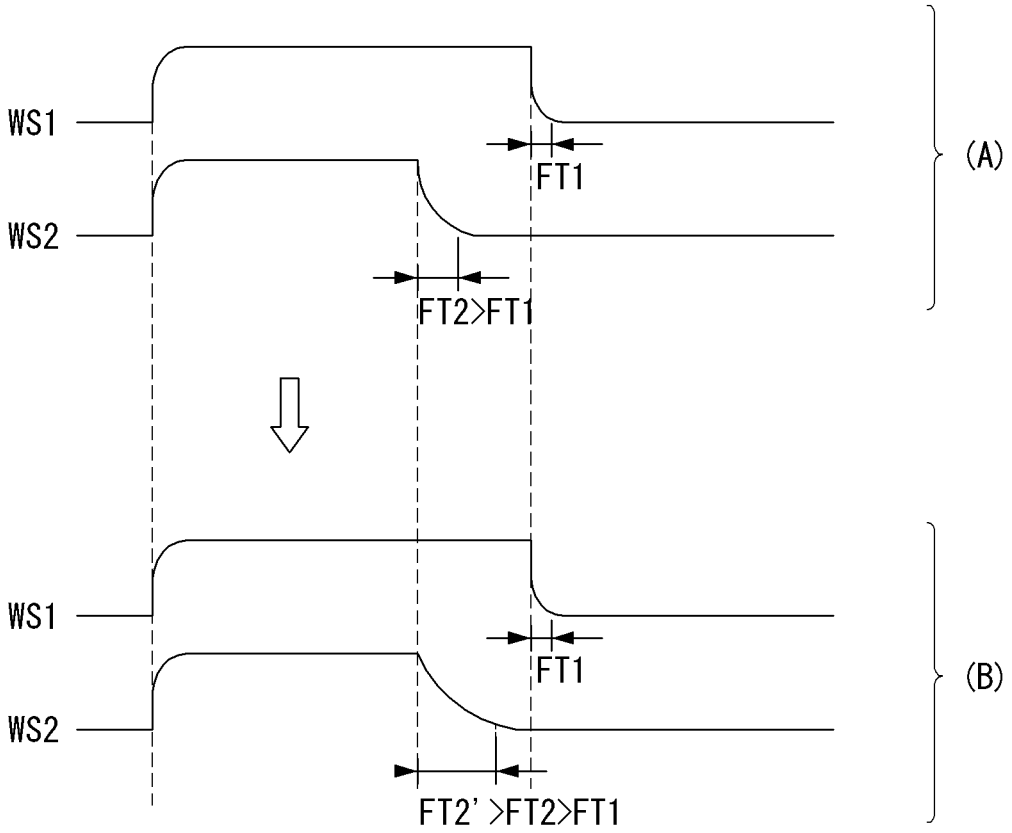
FIG. 13 is a diagram illustrating one scheme to minimize the difference in the sensing period depending on the grayscale.
Figure 14A:
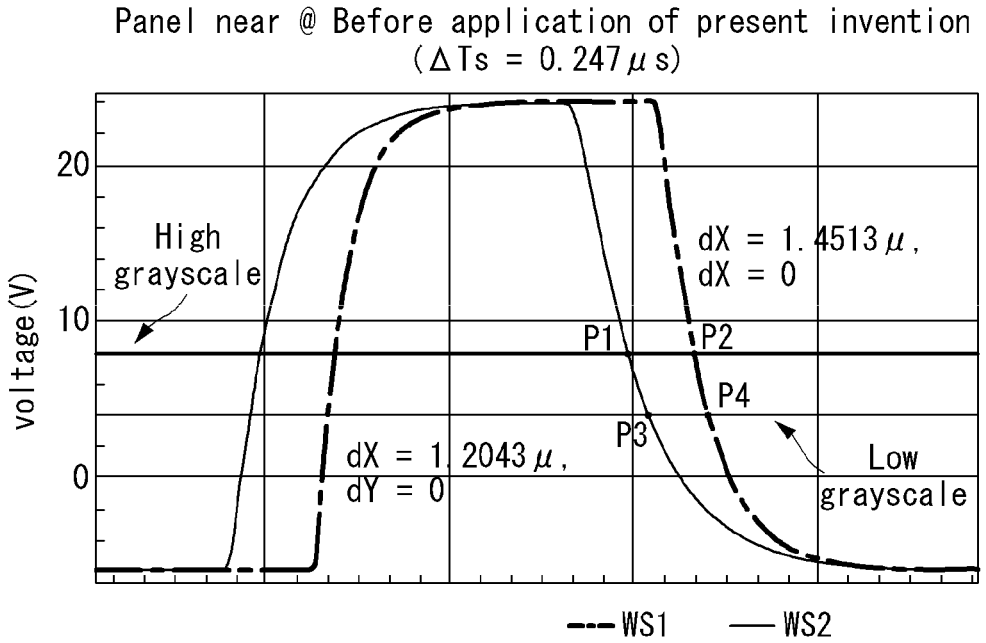
FIG. 14A is a diagram showing a difference in the sensing period between a high grayscale and a low grayscale, a difference in current at a high grayscale, and a difference in current at a low grayscale, before the application of a second embodiment.
Figure 14A:
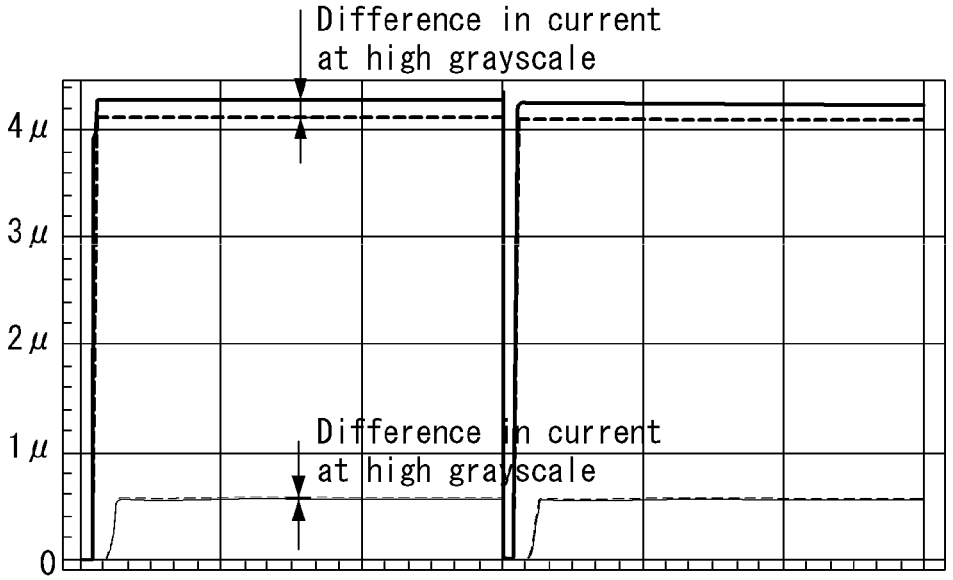
Figure 14B:
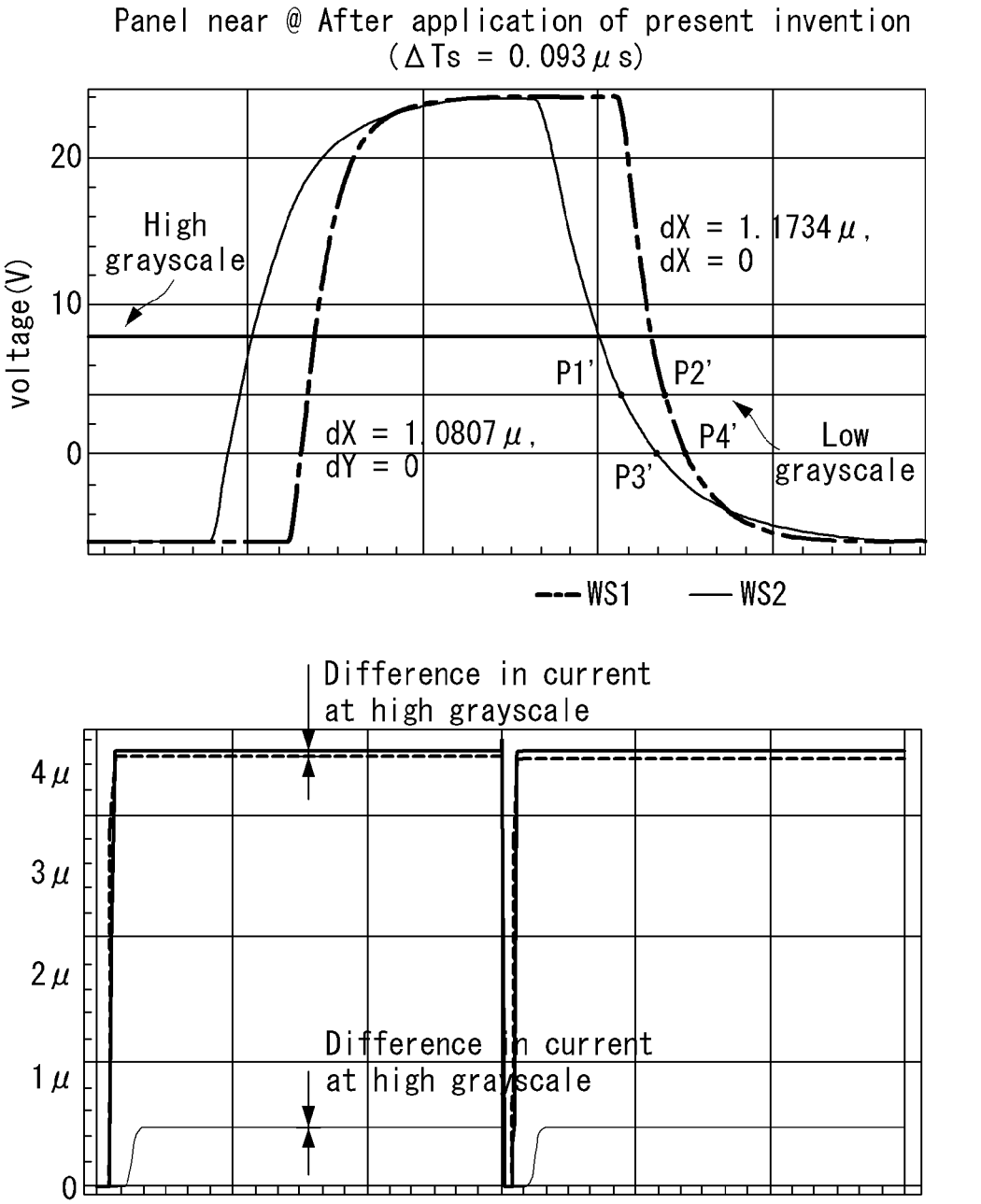
FIG. 14B is a diagram showing a difference in the sensing period between a high grayscale and a low grayscale, a difference in current at a high grayscale, and a difference in current at a low grayscale, after the application of the second embodiment.
Figure 15:
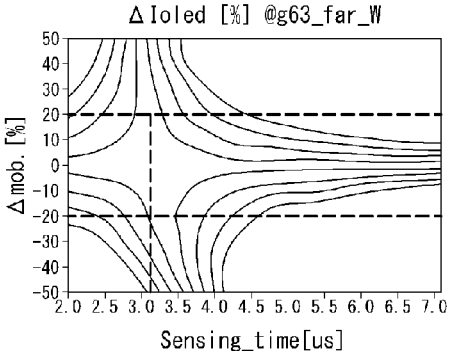
FIG. 15 is a diagram showing that the difference in the sensing period depending on the grayscale is decreased when the falling times of the first and second gate signals are differentially increased than the reference value.
Figure 15:
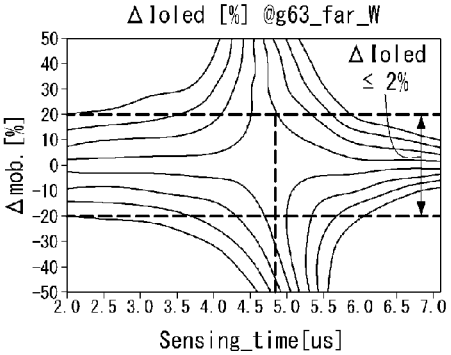
Figure 15:
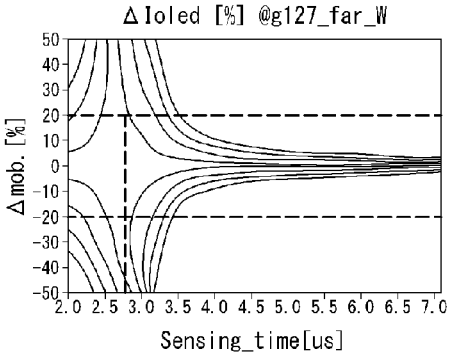
Figure 15:
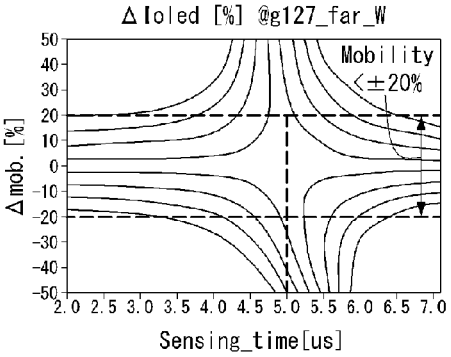

FIG. 13 illustrates one scheme to minimize the difference in the sensing period (Ts) depending on the display position. FIG. 14A shows a difference in the sensing period between a high grayscale and a low grayscale, a difference in current at a high grayscale, and a difference in current at a low grayscale, before the application of a second embodiment. FIG. 14B shows a difference in the sensing period between a high grayscale and a low grayscale, a difference in current at a high grayscale, and a difference in current at a low grayscale, after the application of a second embodiment. FIG. 15 shows that the difference in the sensing period (Ts) depending on the display grayscale is decreased when the falling times of the first and second gate signals WS1 and WS2 are increased to be differentially longer than the reference value.

As one scheme to minimize the difference in the sensing period Ts depending on the display grayscale, the falling times of the first and second gate signals WS1 and WS2 are set to be longer than the reference value through the control of the output slope of the gate driving circuit 13, and here, the falling time of the second gate signal WS2 is set to be longer than the falling time of the first gate signal WS1.

Even though the channel capacities of two CMOS transistors outputting the first and second gate signals WS1 and WS2 are equally reduced, the falling time FT2 of the second gate signal WS2 to which a large load is applied is longer than the falling time FT1 of the first gate output signal WS1, as shown in (A) of FIG. 13. In this situation, according to the present invention, the channel capacities of two CMOS transistors are differentially reduced. That is, according to the present invention, the channel width of the NMOS transistor outputting the second gate signal WS2 is further reduced than the channel width of the NMOS transistor outputting the first gate signal WS1. Therefore, in the present invention, the falling time FT2' of the second gate signal WS2 is set to be longer than the falling time FT1 of the first gate signal WS1, as shown in (B) of FIG. 13.

In the case where the falling times of the first and second gate signals WS1 and WS2 are set to be longer than the reference value through the control of the output slope, the difference in the sensing period depending on the display position can be reduced as described above. However, this constitution has a limitation in decreasing the difference in the sensing period depending on the display grayscale. That is, as shown in FIG. 14A, the difference in the sensing period depending on the display grayscale is 1.4513 μs (interval between P1 and P2)−1.2043 μs (interval between P3 and P4)=0.247 μs, which is a still large value. In addition, the difference in current at the high grayscale is 6%, which is relatively high.

In the case where the falling time FT2' of the second gate signal SW2 is set to be longer than the falling time FT1 of the first gate signal WS1, the difference in the rise of the source voltage of the driving TFT is decreased depending on the display grayscale. That is to say, the difference in the optimum sensing period depending on the display grayscale is decreased. As shown in FIG. 14B, the difference in the sensing period depending on the display grayscale is 1.4734 μs (interval between P1' and P2')−1.0807 μs (interval between P3' and P4')=0.0927 μs, which is significantly decreased. In addition, the difference in current at the high grayscale is also decreased to 2% or less, in the same manner as the difference in current at the low grayscale.

According to the present invention, in the case where the falling time of the second gate signal WS2 is set to be longer than the falling time of the first gate signal WS1 by 2.9 μs through the same control of the gate output slope, and in the case where the falling time of the second gate signal WS2 is set to be longer than the falling time of the first gate signal WS1 by 5.9 μs through the differential control of the gate output slope, the optimum sensing periods at grayscale 65 and grayscale 127 are shown in FIG. 15. The simulation results of FIG. 15 shows that the difference in the optimum sensing period between grayscale 63 and grayscale 127 was more decreased by 50% (the decrease of from 4.0 μs to 2.0 μs) when the difference in the falling time was 5.9 μs rather than when the difference in the falling time was 2.9 μs.

This second embodiment may be applied together with the first embodiment, and in such a case, the difference in the optimum sensing periods depending on the display position and the display grayscale are all decreased.

Third Embodiment

Figure 16A:
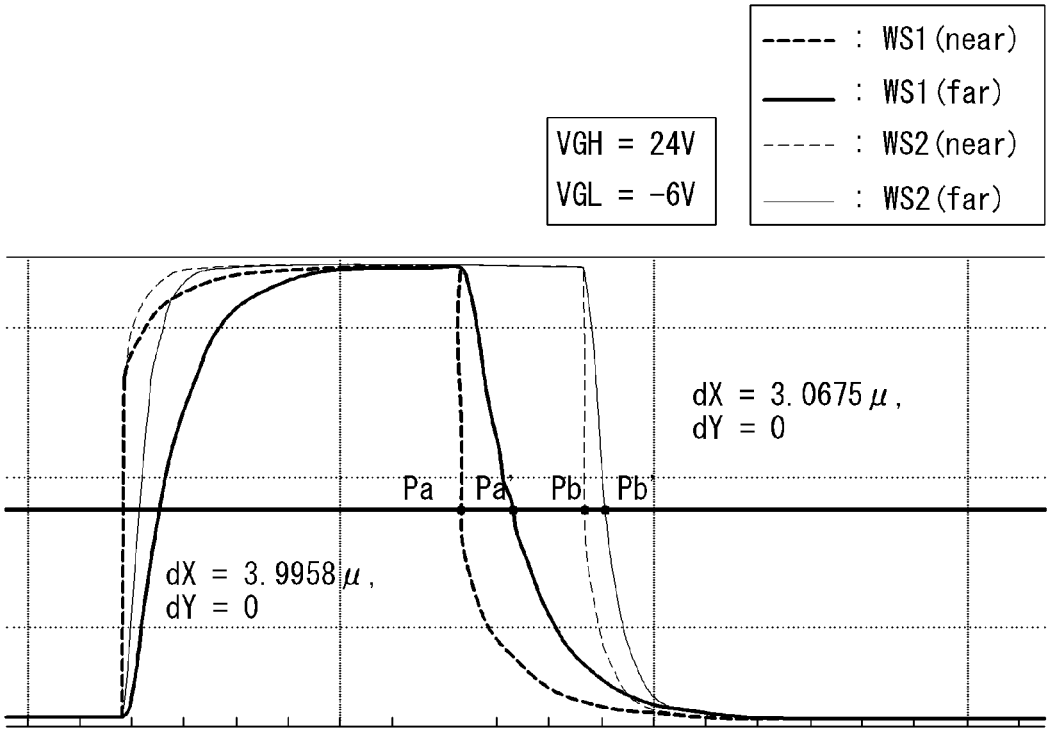
FIGS. 16A and 16B are diagrams illustrating one scheme to minimize the difference in the sensing period depending on the display position.
Figure 16B:
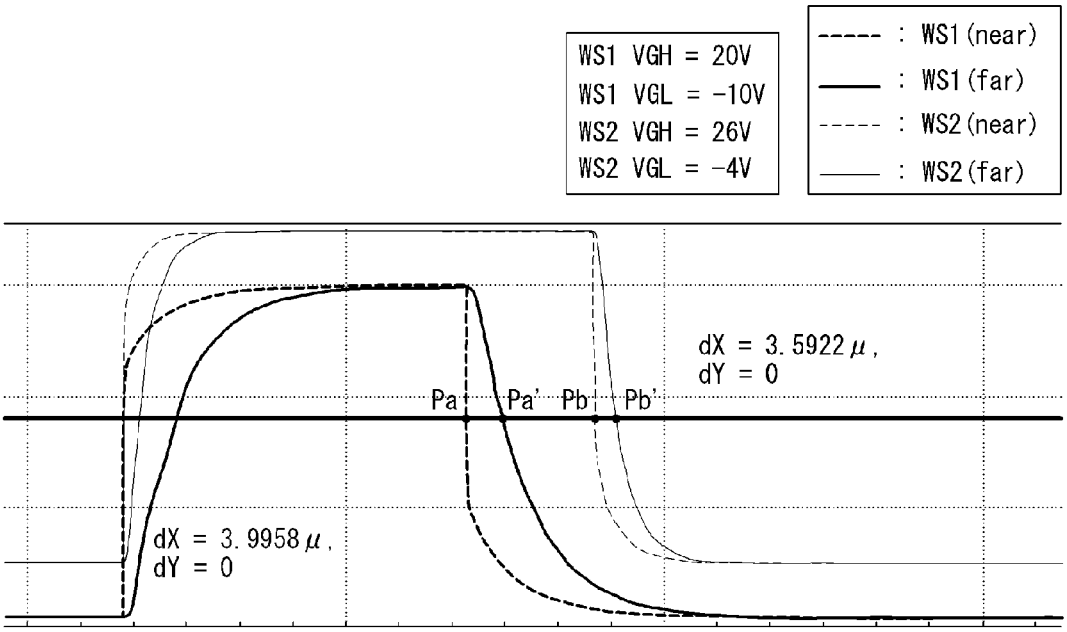
Figure 17:
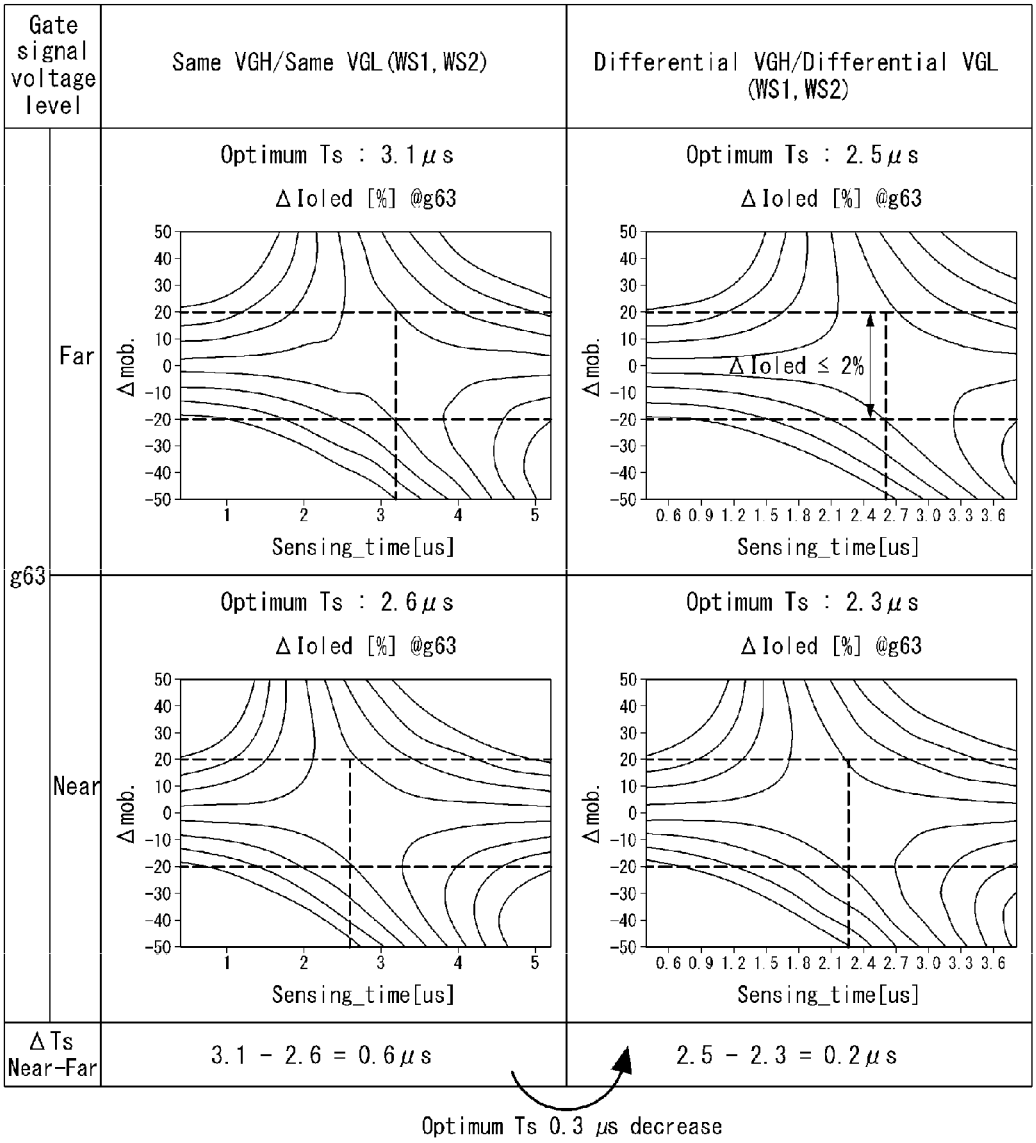
FIG. 17 shows simulation results in which the difference in the sensing period depending on the display position is decreased by differentially controlling voltage levels of the first and second gate signals.
Figure 18:
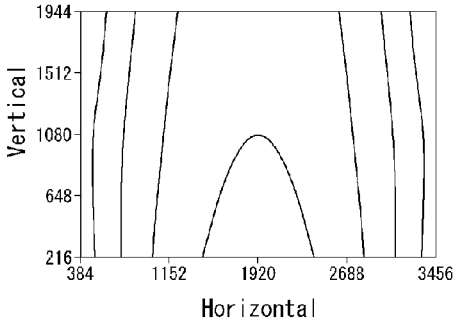
FIG. 18 shows simulation results in which the brightness uniformity of the display panel is improved by differently controlling voltage levels of the first and second gate signals.
Figure 18:
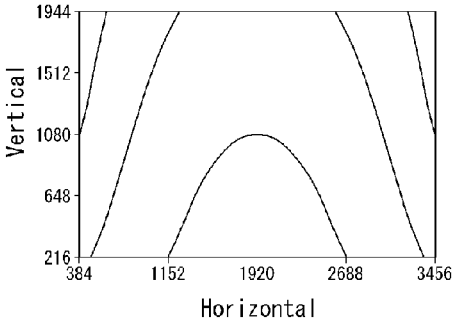

FIGS. 16A and 16B illustrate one scheme to minimize the difference in the sensing period (Ts) depending on the display position. FIG. 17 shows simulation results in which the difference in the sensing period (Ts) depending on the display position is decreased by differently controlling voltage levels of the first and second gate signals WS1 and WS2. FIG. 18 shows simulation results in which the uniformity in brightness of the display panel is improved by differently controlling voltage levels of the first and second gate signals WS1 and WS2.

According to the present invention, as one scheme to minimize the difference in the sensing period (Ts) depending on the display position, the voltage levels of the first and second gate signals WS1 and WS2 are set to be different from each other. That is, according to the present invention, while the voltage differences between the ON level VGH and the OFF level VGL for the first and second gate signals WS1 and WS2 are maintained to be the same as each other, the ON levels of the first and second gate signals WS1 and WS2 are set to be different from each other and the OFF levels of the first and second gate signals WS1 and WS2 are set to be different from each other. According to the present invention, the ON level of the first gate signal WS1 is set to be higher than the ON level of the second gate signal WS2, and the OFF level of the first gate signal WS1 is set to be higher than the OFF level of the second gate signal WS2. When the voltage levels of the first and second gate signals WS1 and WS2 are differentially set as described above, the difference in the sensing period depending on the display position can be decreased.

As shown in FIG. 16A, when the voltage levels of the first and second gate signals WS1 and WS2 are set to be the same as each other (VGH 24 V, VGL −6 V), the difference in the sensing period depending on the display position is 3.9958 μs (interval between Pa and Pb)−3.0675 μs (interval between Pa' and Pb')=0.93 μs, which is relatively large.

On the other hand, as shown in FIG. 16B, when the voltage levels of the first and second gate signals WS1 and WS2 are differentially set (WS1 VGH 20 V, WS1 VGL −10 V, WS2 VGH 26 V, WS2 VGL −4 V), the difference in the sensing period depending on the display position is 3.9958 μs (interval between Pa and Pb)−3.5922 μs (interval between Pa' and Pb')=0.41 μs, which is significantly decreased.

As such, the voltage levels of the first and second gate signals WS1 and WS2 are differentially set, thereby significantly decreasing the difference in the optimum sensing period depending on the display position. As shown in FIG. 17, when the difference in the optimum sensing period depending on the display position is compared between before and after the present invention is applied, the difference in the optimum sensing period at the time of the differential voltage level setting, 0.2 μs, is decreased by 0.3 μs than the difference at the time of the same voltage level setting, 0.5 μs.

As shown in FIG. 18, when the uniformity in global brightness of the display panel is numerically expressed, the uniformity in global brightness at the time of the differential voltage level setting, 87.4%, is improved by 7.3% than the uniformity in global brightness at the time of the same voltage level setting, 80.1%.

This third embodiment may be applied together with the first embodiment, and in such a case, the difference in the optimum sensing period depending on the display position is further decreased.

Fourth Embodiment

Figure 19:
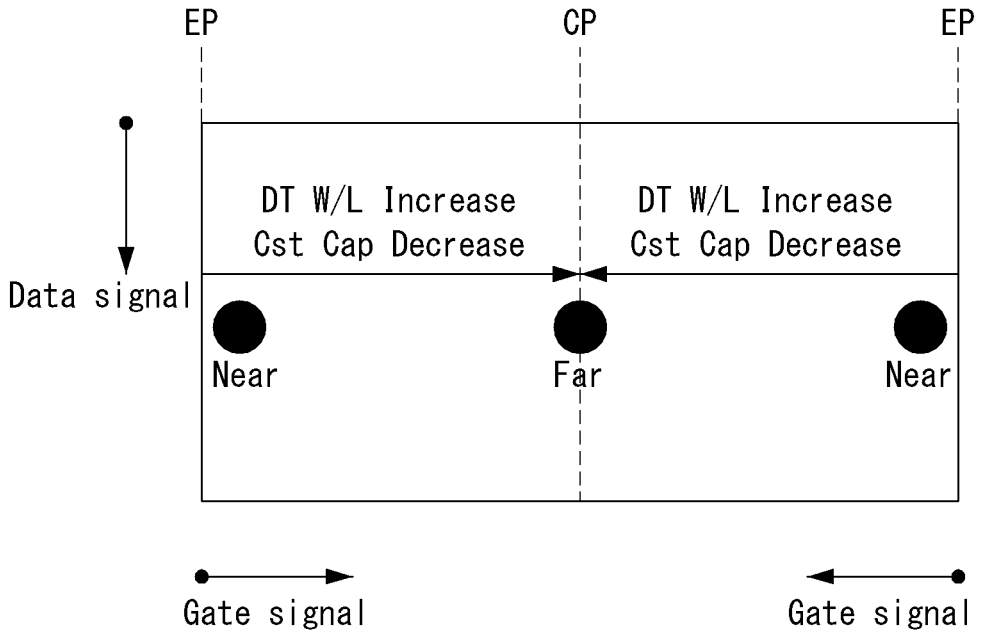
FIG. 19 is a diagram illustrating one scheme to minimize the difference in the sensing period depending on the display position.
Figure 20:
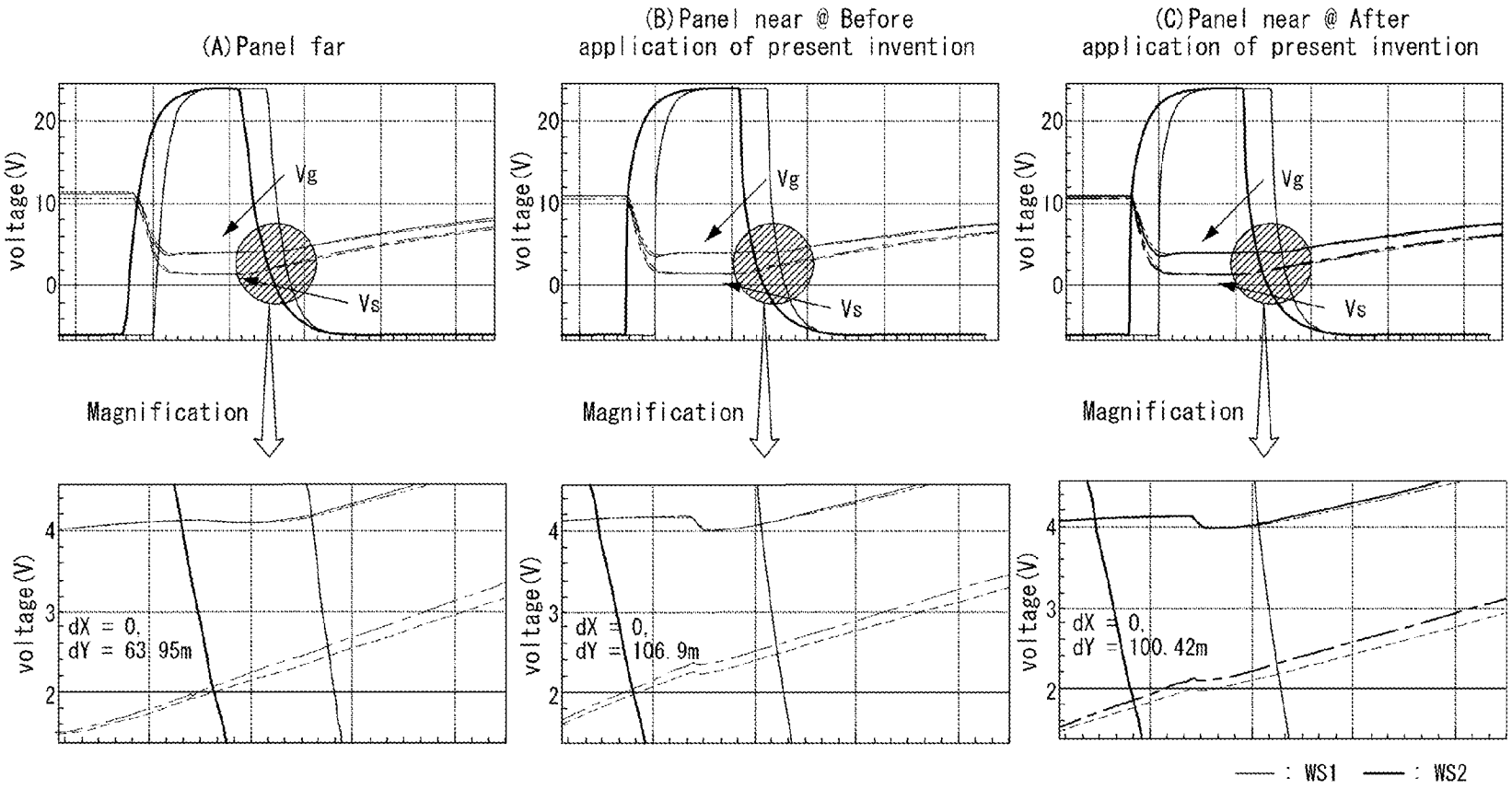
FIGS. 20 and 21 show simulation results in which the compensation performance depending on the position is improved by changing the size of the driving TFT depending on the display position.
Figure 21:
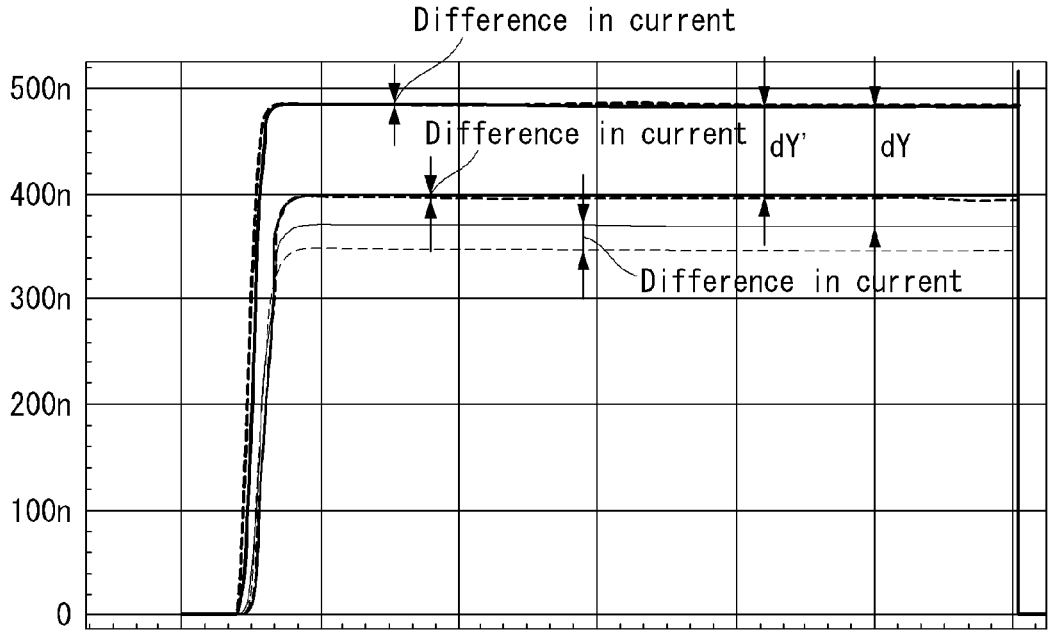
Figure 22:
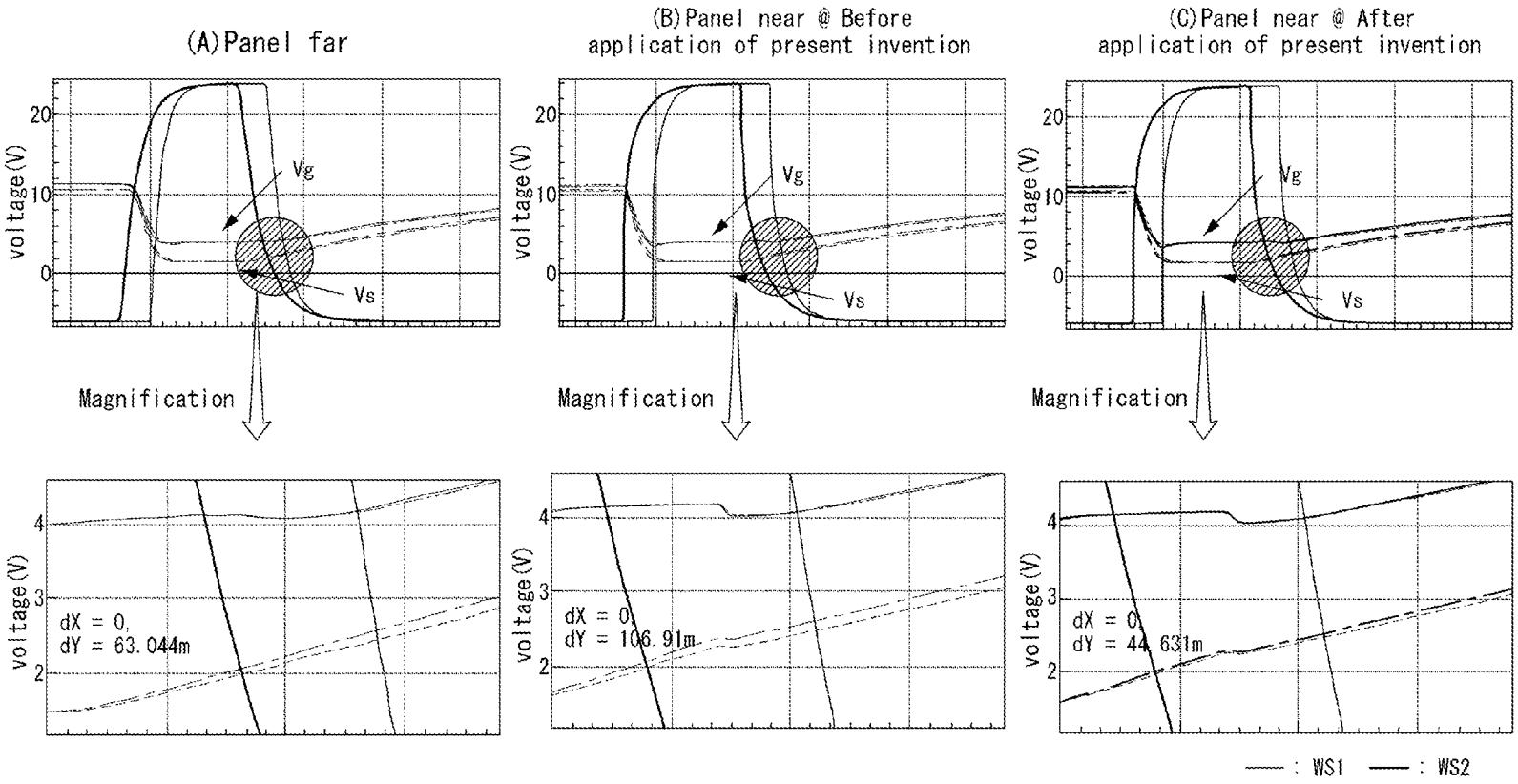
FIGS. 22 and 23 show simulation results in which the compensation performance depending on the position is improved by changing the size of the storage capacitor depending on the display position.
Figure 23:
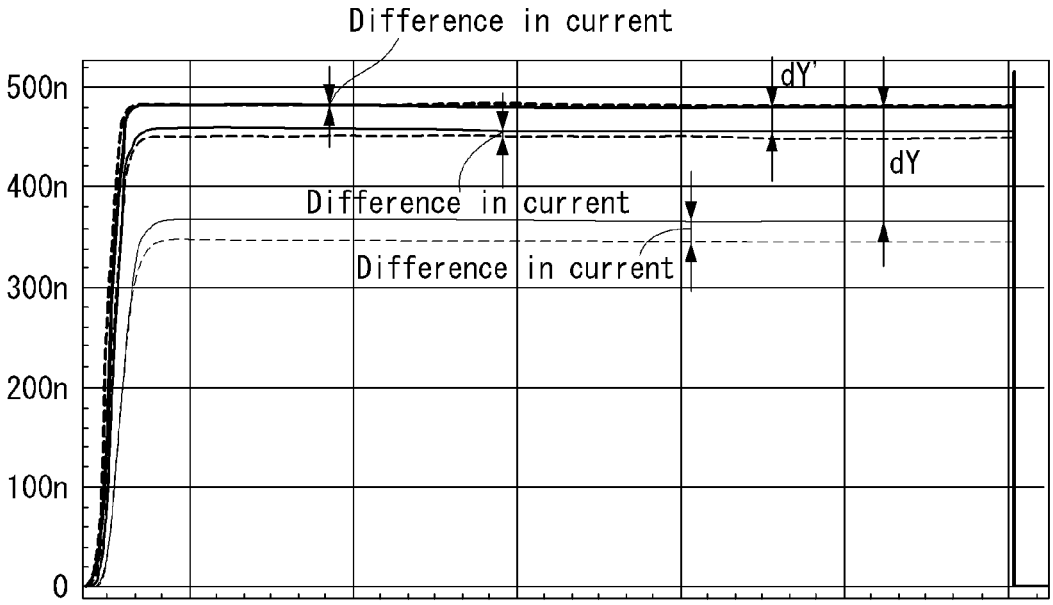
Figure 24:
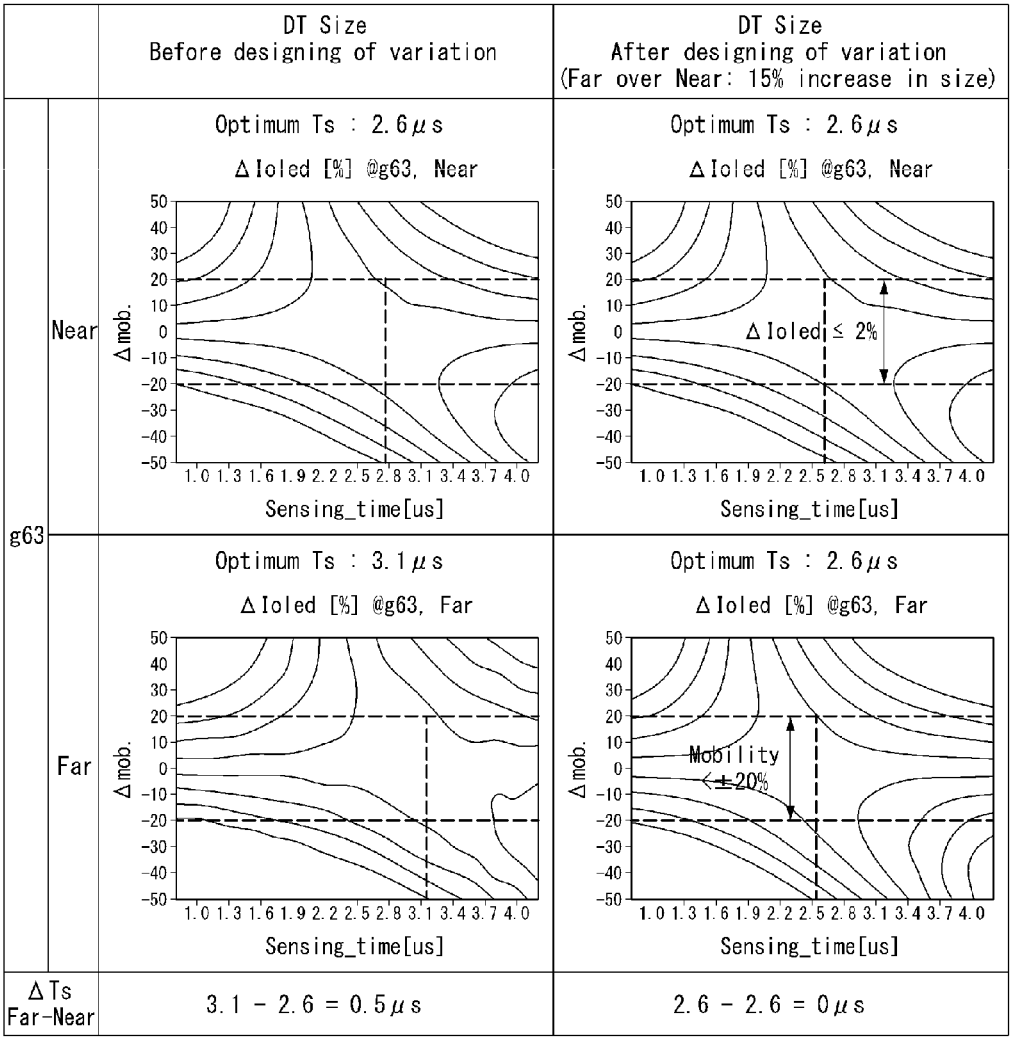
FIG. 24 shows simulation results in which the difference in the sensing period depending on the position is decreased by changing the size of the driving TFT depending on the display position.
Figure 25:
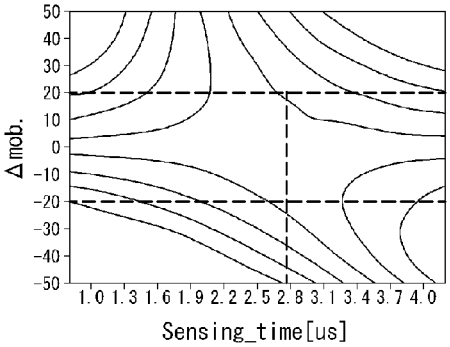
FIG. 25 shows simulation results in which the difference in the sensing period depending on the position is decreased by changing the size of the storage capacitor depending on the display position.
Figure 25:
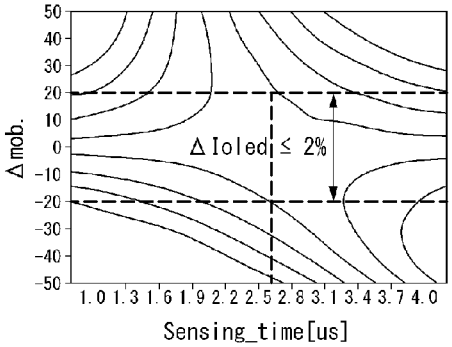
Figure 25:
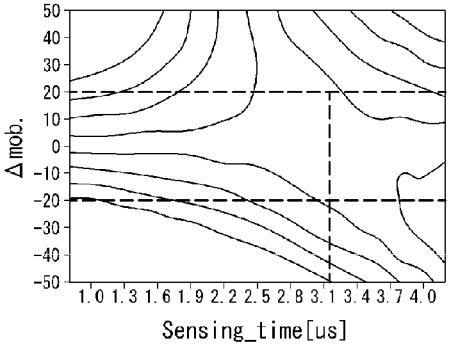
Figure 25:
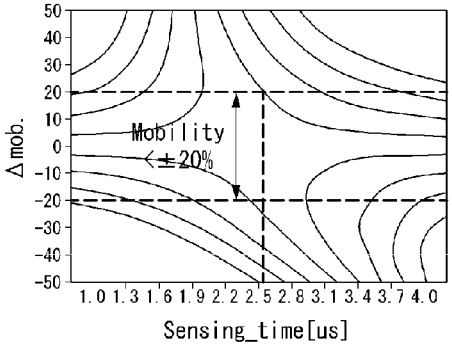

FIG. 19 illustrates one scheme to minimize the difference in the sensing period (Ts) depending on the display position. FIGS. 20 and 21 show simulation results in which the compensation performance depending on the display position is improved by changing the size of the driving TFT depending on the display position. FIGS. 22 and 23 show simulation results in which the compensation performance depending on the display position is improved by changing the size of the storage capacitor depending on the display position. FIG. 24 shows simulation results in which the difference in the sensing period depending on the display position is decreased by changing the size of the driving TFT depending on the display position. FIG. 25 shows simulation results in which the difference in the sensing period depending on the display position is decreased by changing the size of the storage capacitor depending on the display position.

When, on the display panel, a region disposed near to the gate driving circuit is designated by a first region EP and a region disposed far from the gate driving circuit is designated by a second region CP, the RC delay applied to the first and second gate signals WS1 and WS2 is gradually increased from the first region EP to the second region CP. According to the present invention, in order to minimize the difference in the sensing period Ts depending on the display position, the size of the driving TFT is changed depending on the display position, and/or the size of the storage capacitor is changed depending on the display position.

Due to the RC delay of the gate line, it is not easy to equally set the optimum sensing period in all regions of the display panel. However, when the size of the driving TFT is changed depending on the display position, and/or the size of the storage capacitor is changed depending on the display position as described herein, the source voltage of the driving TFT can be raised at a uniform rate in all regions of the display panel regardless of the RC delay, thereby minimizing the difference in the sensing period Ts depending on the display position.

Herein, the channel capacity of the driving TFT is gradually increased from the first region EP toward the second region CP. In other words, as the RC delay is increased depending on the display position, the channel width of the driving TFT formed at a corresponding position is increased. According to the present invention, the current capacity of the driving TFT depending on the display position is varied to improve the performance of compensating the mobility. As can be clearly seen from the simulation results of FIGS. 20 and 21, the application of the present invention can reduce the difference in current between the first region EP and the second region CP from dY to dY'.

Herein, the capacity of the storage capacitor is gradually reduced from the first region EP toward the second region CP. According to the present invention, since the capacitance of the storage capacitor, which varies depending on the display position, changes the rate of the rise of the source voltage of the driving TFT during the sensing period, the performance of compensating the mobility is improved. As can be clearly seen from the simulation results of FIGS. 22 and 23, the application of the present invention can decrease the difference in current between the first region EP and the second region CP from dY to dY'.

It can be seen from the simulation results of FIG. 24 that, when the channel capacity of the driving TFT in the second region CP compared with the first region EP is increased by 15%, the difference in the sensing period depending on the display position is zero. Further, it can be seen from the simulation results of FIG. 25 that, when the capacity of the storage capacitor in the second region CP compared with the first region EP is increased by 20%, the difference in the sensing period depending on the display position is zero.

The fourth embodiment may be applied together with the above-described first to third embodiments, and in such a case, the effect of decreasing the differences in the sensing period depending on the display position and the display grayscale can be maximized.

As set forth above, when the difference in mobility of the driving TFT is compensated in a hybrid compensation manner, the difference in the sensing period depending on the display position or the display grayscale is decreased, thereby improving the performance of compensating the mobility of the driving TFT and the uniformity in brightness of the display panel.

Through the above descriptions, those skilled in the art will understand that various changes and modifications may be made without departing from the spirit and scope of the invention. Therefore, it is intended that the technical range of the present invention is not limited to the detailed descriptions of the specification but should be defined by claims.

What is claimed is:

1. An organic light emitting display, comprising:

a display panel having a plurality of pixels each including an organic light emitting diode, a driving TFT controlling a driving current flowing through the organic light emitting diode depending on a voltage difference between a gate electrode connected to a first node and a source electrode connected to a second node, a first switch TFT switched in response to a first gate signal to apply a data voltage to the first node, a second switch TFT switched in response to a second gate signal to apply an initialization voltage to the second node, and a storage capacitor connected between the first node and the second node;

a data driving circuit supplying the data voltage to a data line connected to the plurality of pixels and supplying the initialization voltage to a reference line connected to the plurality of pixels; and a gate driving circuit supplying the first gate signal to a first gate line connected to the plurality of pixels and supplying the second gate signal to a second gate line connected to the plurality of pixels, wherein, in a sensing period during which differences in mobilities of the driving TFTs are compensated, the first gate signal is maintained at an ON level and the second gate signal is maintained at an OFF level, the first and second gate signals are maintained at an OFF level in a light emission period following the sensing period, and a gate voltage and a source voltage of the driving TFT are raised to a voltage level higher than the threshold voltage of the organic light emitting diode while a gate-source voltage of the driving TFT supplied during the sensing period is maintained, and wherein the differences in the mobilities of the driving TFTs are compensated by setting a first falling time of the first gate signal and a second falling time of the second gate signal after compensation, which indicate periods of time required to respectively change the first gate signal and the second gate signal from the ON level to the OFF level, to be 4-6 times longer than the first falling time of the first gate signal and the second falling time of the second gate signal before compensation.

2. The organic light emitting display of claim 1, wherein the second falling time is set to be longer than the first falling time.

3. The organic light emitting display of claim 1, wherein the gate driving circuit includes a first CMOS inverter outputting the first gate signal through a first output node, and a second CMOS inverter outputting the second gate signal through a second output node, wherein the first CMOS inverter includes a first PMOS transistor connected between a high-voltage power of the ON level and the first output node and a first NMOS transistor connected between a low-voltage power of the OFF level and the first output node, wherein the second CMOS inverter includes a second PMOS transistor connected between a high-voltage power of the ON level and the second output node and a second NMOS transistor connected between a low-voltage power of the OFF level and the second output node, and wherein the channel capacities of the first and second NMOS transistors are, respectively, controlled according to the setting of the first and second falling times.

4. The organic light emitting display of claim 1, wherein a voltage difference between the ON level and the OFF level of the first gate signal is equal to a voltage difference between ON level and the OFF level of the second gate signal, and wherein the ON levels of the first and second gate signals are different from each other, and the OFF levels of the first and second gate signals are different from each other.

5. The organic light emitting display of claim 4, wherein the ON level of the first gate signal is higher than the ON level of the second gate signal, and the OFF level of the first gate signal is higher than the OFF signal of the second gate signal.

6. The organic light emitting display of claim 1, wherein, when an RC delay applied to the first and second gate signals is gradually increased from a first region toward a second region of the display panel, the channel capacity of the driving TFT is gradually increased from the first region toward the second region.

7. The organic light emitting display of claim 1, wherein, when an RC delay applied to the first and second gate signals is gradually increased from a first region toward a second region of the display panel, the capacitance of the storage capacitor is gradually decreased from the first region toward the second region.

8. The organic light emitting display of claims 1, wherein, when an RC delay applied to the first and second gate signals is gradually increased from a first region toward a second region of the display panel, the channel capacity of the driving TFT is gradually increased from the first region toward the second region, and the capacitance of the storage capacitor is gradually decreased from the first region toward the second region.

9. The organic light emitting display of claim 1, wherein the ON level is equivalent to 100% of a gate high voltage and the OFF level is equivalent to 10% of the gate high voltage.

10. The organic light emitting display of claim 1, wherein the differences in mobilities of the driving TFTs are compensated by ±20%.

11. An organic light emitting display, comprising:

a display panel having a plurality of pixels each including an organic light emitting diode, a driving TFT controlling a driving current flowing through the organic light emitting diode depending on a voltage difference between a gate electrode connected to a first node and a source electrode connected to a second node, a first switch TFT switched in response to a first gate signal to apply a data voltage to the first node, a second switch TFT switched in response to a second gate signal to apply an initialization voltage to the second node, and a storage capacitor connected between the first node and the second node;

a data driving circuit supplying the data voltage to a data line connected to the plurality of pixels and supplying the initialization voltage to a reference line connected to the plurality of pixels; and a gate driving circuit supplying the first gate signal to a first gate line connected to the plurality of pixels and supplying the second gate signal to a second gate line connected to the plurality of pixels, wherein, in a sensing period during which differences in mobilities of the driving TFTs are compensated, the first gate signal is maintained at an ON level and the second gate signal is maintained at an OFF level, and the first and second gate signals are maintained at an OFF level in a light emission period following the sensing period, wherein the differences in the mobilities of the driving TFTs are compensated by setting a first falling time of the first gate signal and a second falling time of the second gate signal after compensation, which indicate periods of time required to respectively change the first gate signal and the second gate signal from the ON level to the OFF level, to be longer than the first falling time of the first gate signal and the second falling time of the second gate signal before compensation, and wherein the second falling time is set to be longer than the first falling time.

12. The organic light emitting display of claim 11, wherein the ON level is equivalent to 100% of a gate high voltage and the OFF level is equivalent to 10% of the gate high voltage.

* * * * *